US009577338B2

(12) United States Patent
Pan et al.

(10) Patent No.: US 9,577,338 B2
(45) Date of Patent: Feb. 21, 2017

(54) ANTENNA FOR ACHIEVING EFFECTS OF MIMO ANTENNA

(71) Applicants: Chun-Jui Pan, New Taipei (TW); Sheng-Hsiung Yang, New Taipei (TW); Wen-Chieh Tsai, New Taipei (TW)

(72) Inventors: Chun-Jui Pan, New Taipei (TW); Sheng-Hsiung Yang, New Taipei (TW); Wen-Chieh Tsai, New Taipei (TW)

(73) Assignee: HON HAI PRECISION INDUSTRY CO., LTD., New Taipei (TW)

( * ) Notice: Subject to any disclaimer, the term of this patent is extended or adjusted under 35 U.S.C. 154(b) by 533 days.

(21) Appl. No.: 13/656,753

(22) Filed: Oct. 22, 2012

(65) Prior Publication Data

US 2013/0106670 A1 May 2, 2013

(30) Foreign Application Priority Data

Oct. 28, 2011 (TW) ..... 100139312 A

(51) Int. Cl.

| | |
|---|---|
| ***H01Q 9/42*** | (2006.01) |
| ***H01Q 1/50*** | (2006.01) |
| ***H01Q 5/378*** | (2015.01) |
| ***H01Q 5/35*** | (2015.01) |
| ***H01Q 1/38*** | (2006.01) |

(52) U.S. Cl.

CPC ..... *H01Q 9/42* (2013.01); *H01Q 1/38* (2013.01); *H01Q 1/50* (2013.01); *H01Q 5/35* (2015.01); *H01Q 5/378* (2015.01)

(58) Field of Classification Search

CPC ..... H01Q 5/35; H01Q 5/378

See application file for complete search history.

(56) References Cited

U.S. PATENT DOCUMENTS

| | | | | |
|---|---|---|---|---|
| 2008/0174508 | A1* | 7/2008 | Iwai et al. | 343/850 |
| 2008/0305749 | A1 | 12/2008 | Ben-Bassat | |
| 2009/0027286 | A1* | 1/2009 | Ohishi et al. | 343/750 |
| 2011/0122040 | A1* | 5/2011 | Wakabayashi | 343/833 |
| 2013/0016024 | A1* | 1/2013 | Shi | H01Q 1/243 343/833 |

FOREIGN PATENT DOCUMENTS

| | | |
|---|---|---|
| CN | 201845871 U | 5/2011 |
| TW | 200908434 | 2/2009 |
| TW | M388741 | 9/2010 |

* cited by examiner

*Primary Examiner* — Robert Karacsony
(74) *Attorney, Agent, or Firm* — Zhigang Ma

(57) ABSTRACT

An antenna disposed on a substrate includes a radiating portion, a first coupling and feeding portion, and a second coupling and feeding portion. A length of the radiating portion is substantially equal to a half wavelength of electromagnetic signals radiated by the radiating portion. Each coupling and feeding portion includes a feeding part and a coupling part. The feeding part feeds the electromagnetic signals to the radiating portion via the coupling part so as to achieve effects of a multiple-input multiple-output (MIMO) antenna. A gap is defined between the coupling part and the radiating portion to improve an isolation of the MIMO antenna.

11 Claims, 29 Drawing Sheets

520

ANTENNA FOR ACHIEVING EFFECTS OF MIMO ANTENNA

BACKGROUND

1. Technical Field

The present disclosure relates to wireless communications, and more particularly to an antenna for achieving effects of an MIMO antenna.

2. Description of Related Art

Multiple-input multiple-output (MIMO) antennas are widely used to improve communication quality of electronic devices in a printed circuit board (PCB) because an MIMO antenna offers significant increases in data throughput and link range without additional bandwidth or increased transmission power. Usually, an MIMO antenna is collectively formed by two normal antennas or by an antenna array, which needs large dimensions in the PCB in an electronic device. Accordingly, it is important to provide an antenna that will achieve effects of the MIMO antenna and fit in a smaller PCB with enhanced isolation and improved radiating performance.

BRIEF DESCRIPTION OF THE DRAWINGS

Many aspects of the exemplary embodiments can be better understood with reference to the following drawings. The components in the drawings are not necessarily drawn to scale, the emphasis instead being placed upon clearly illustrating the principles of the exemplary embodiments. Moreover, in the drawings, all the views are schematic, and like reference numerals designate corresponding parts throughout the several views.

DETAILED DESCRIPTION

The disclosure is illustrated by way of example and not by way of limitation in the figures of the accompanying drawings in which like references indicate similar elements. It should be noted that references to "an" or "one" embodiment in this disclosure are not necessarily to the same embodiment, and such references mean at least one.

Figure 1:
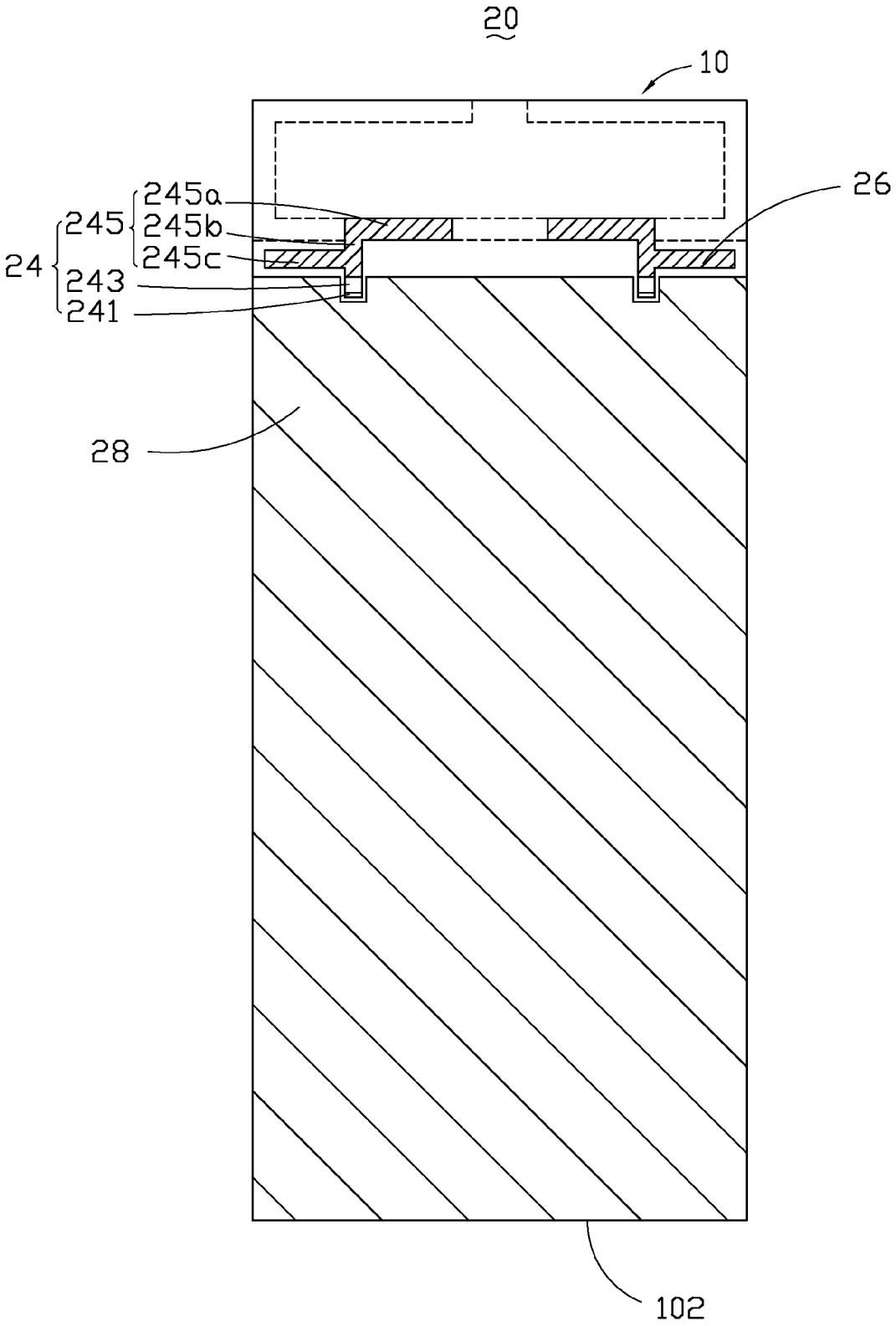
FIG. 1 shows a view of one embodiment of a first surface of a first antenna in accordance with the present disclosure.
Figure 2:
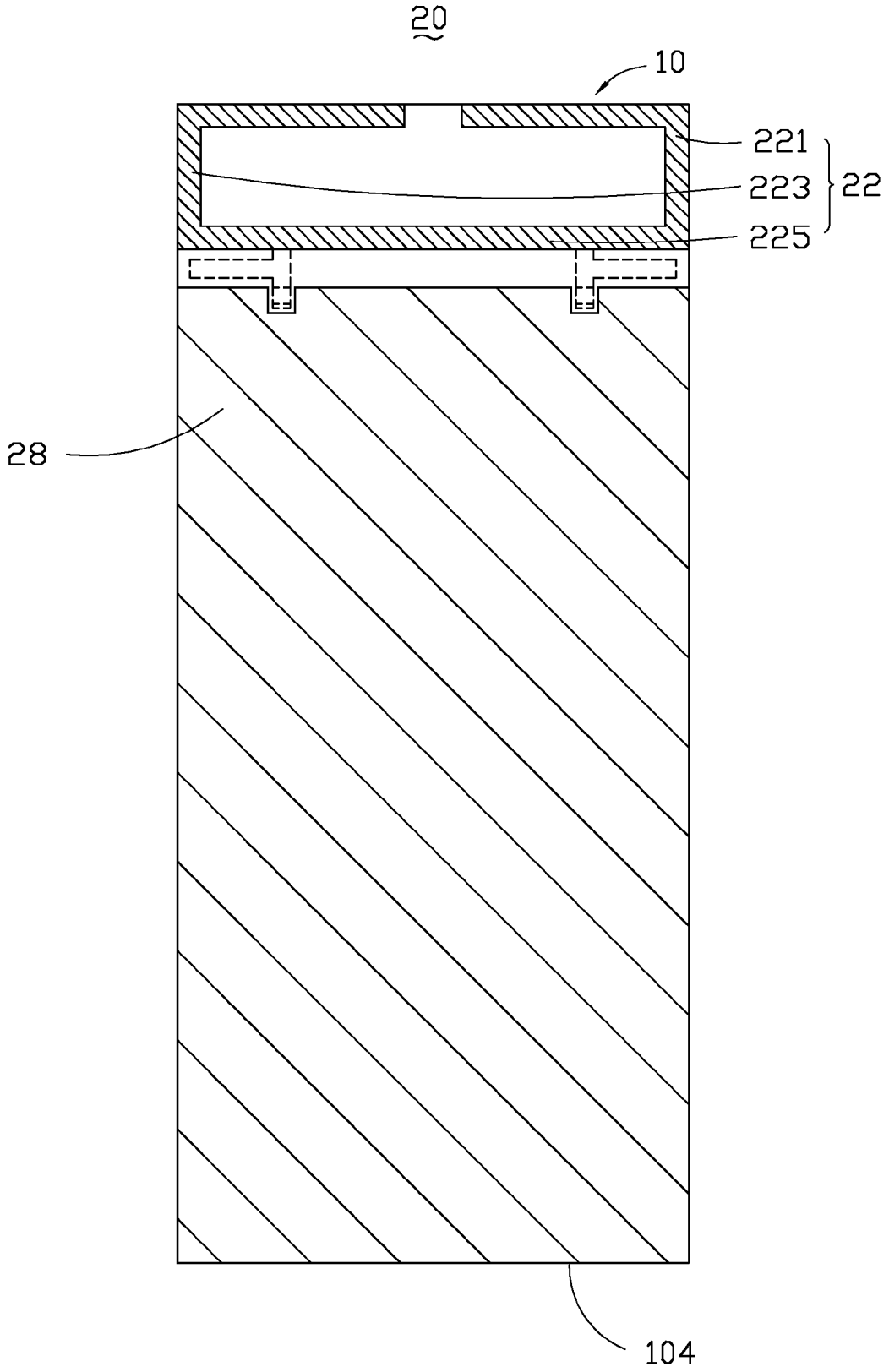
FIG. 2 shows a view of one embodiment of a second surface of the first antenna shown in FIG. 1 in accordance with the present disclosure.

FIG. 1 shows a view of one embodiment of a first surface 102 of a first antenna 20 in accordance with the present disclosure. FIG. 2 shows a view of one embodiment of a second surface 104 of the first antenna 20 shown in FIG. 1 in accordance with the present disclosure.

In one embodiment, the first antenna 20 is located on a substrate 10. The substrate 10 may be a printed circuit board (PCB) and includes a first surface 102 (shown in FIG. 1) and a second surface 104 (shown in FIG. 2) opposite to the first surface 102.

The first antenna 20 includes a radiating portion 22 (shown in FIG. 2), a first coupling and feeding portion 24 (shown in FIG. 1), a second coupling and feeding portion 26 (shown in FIG. 1), and a grounding portion 28 (shown in FIG. 1 and FIG. 2).

As shown in FIG. 2, the radiating portion 22 is located on the second surface 104 of the substrate 10 and radiates electromagnetic signals from the first coupling and feeding portion 24 and the second coupling and feeding portion 26. In one embodiment, the radiating portion 22 is axially symmetric and forms a meandering pattern about $\lambda/2$ in length, where $\lambda$ is a wavelength of the electromagnetic signals. It is noted that the radiating portion 22 can be in any type of meandering patterns.

In one embodiment, the radiating portion 22 includes a first radiating part 221, a second radiating part 223, and a third radiating part 225. In the exemplary embodiment, the first radiating part 221, the third radiating part 225, and the second radiating part 223 are connected in series and collectively form a meandering pattern. By way of illustration and not as a limitation, the first radiating part 221 and the second radiating part 223 are both in the shape of an "L" and are axial symmetrical. The third radiating part 225 is in a strip shape. For example, the first radiating part 221, the third radiating part 225, and the second radiating part 223 collectively form a rectangle with a gap defined at center of one side of the rectangle.

As shown in FIG. 1, the first and second coupling and feeding portions 24 and 26 are located on the first surface 102 of the substrate 10. The first coupling and feeding portion 24 is axial symmetrical to the second coupling and feeding portion 26 and shares a same symmetrical axis of the radiating portion 22. Structure of the first coupling and feeding portion 24 is the same as that of the second coupling and feeding portion 26. Thus, detailed description about the second coupling and feeding portion 26 is not described for simplicity.

The first coupling and feeding portion 24 includes a feeding part 241, a matching part 243 and a coupling part 245. The feeding part 241 feeds electromagnetic wave signals to the radiating portion 22. The coupling part 245 includes a first coupling unit 245*a*, a second coupling unit 245*b* and a third coupling unit 245*c*. The matching part 243 matches impedance between the feeding part 241 and the coupling part 245. In one embodiment, one end of the matching part 243 is electrically connected to the feeding part 241 and the other end is electrically connected to the second coupling unit 245*b* of the coupling part 245. The matching part 243 may be one of various types of LC matching circuits, such as a L-type LC matching circuit, a $\pi$-type LC matching circuits, and a T-type LC matching circuit, for example.

Figure 3A:
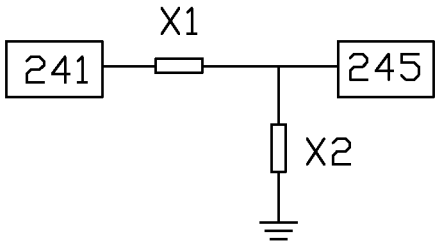
FIG. 3A-3D show schematic views of several embodiments of a matching circuit included in a matching part of the first antenna shown in FIG. 1 in accordance with the present disclosure.
Figure 3B:
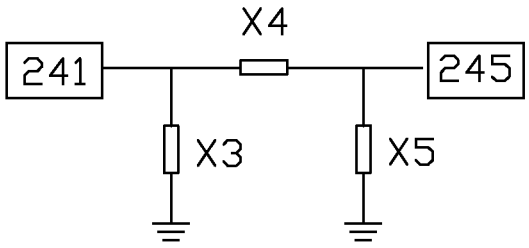
Figure 3C:
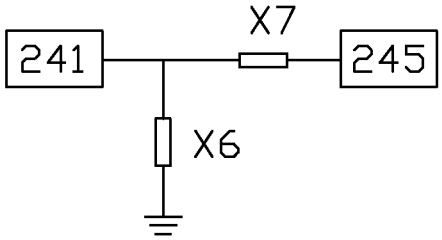
Figure 3D:
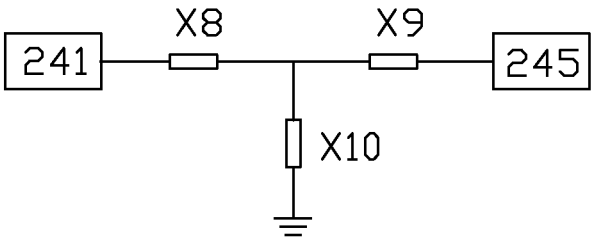

FIG. 3A-3D show schematic views of several embodiments of a matching circuit included in a matching part 243 of the first antenna 20 shown in FIG. 1 in accordance with the present disclosure. FIGS. 3A and 3C show two kinds of the L-type LC matching circuit. FIG. 3B shows one kind of the $\pi$-type LC matching circuit. FIG. 3D shows one kind of the T-type LC matching circuit. In the exemplary embodiment, X1-X10 can be inductance components or capacitance components. Impedance matching is achieved by selecting one of the various types of LC matching circuits through calculating impedance of the first antenna 20, thereby enhancing radiating performance of the first antenna 20.

Referring to FIGS. 1 and 2, the coupling part 245 improves isolation and includes an elongated first coupling unit 245*a*, an elongated second coupling unit 245*b*, and an elongated third coupling unit 245*c*.

In the exemplary embodiment, the second coupling unit 245*b* is parallel to the symmetrical axis of the radiating portion 22 and locates between the first coupling unit 245*a* and the third coupling unit 245*c*. The first coupling unit 245*a* and the third coupling unit 245*c* are parallel to each other.

The first coupling unit 245*a* and the second coupling unit 245*b* are connected and collectively form an "L" shape, wherein the first coupling unit 245*a* is perpendicularly connected to one end of the second coupling unit 245*b* which is distal to the feeding part 241. The third coupling unit 245*c* and the second coupling unit 245*b* are connected and collectively form a "T" shape, wherein the third coupling unit 245*c* is perpendicularly connected to the other end of the second coupling unit 245*b*.

In one embodiment, a projection of the third radiating part 225 on the first surface 102 overlaps with the first coupling unit 245*a*. A gap is defined between the third radiating part 225 and the first coupling unit 245*a* due to a partition/separation of the substrate 10. Therefore, current under a specific frequency can be coupled to the radiating portion 22 by the coupling part 245 of the first coupling and feeding portion 24, and the radiating portion 22 can generate radiation and resonance. Thus, current through the second coupling and feeding portion 26 from the first coupling and feeding portion 24 through direct coupling and current through the coupling and feeding portion 24 from the coupling and feeding portion 26 through direct coupling are greatly reduced to improve isolation between the first coupling and feeding portion 24 and the second coupling and feeding portion 26. It is noted that the coupling part 245 of the first coupling and feeding portion 24 can be any type of meandering patterns.

In the present disclosure, each feeding part of the first coupling and feeding portion 24 and the second coupling and feeding portion 26 feeds the electromagnetic signals to the radiating portion 22 via each coupling part of the first coupling and feeding portion 24 and the second coupling and feeding portion 26 respectively so as to achieve effects of a multiple-input multiple-output (MIMO) antenna.

The radiating portion 22 of the first antenna 20 is in a meandering pattern so as to reduce dimensions of the first antenna 20.

The first and second coupling and feeding portions 24 and 26 are axially symmetric and shares the same axis of symmetry with the radiating portion 22. The gap is defined between the first coupling and feeding portion 24 and the radiating portion 22 due to the partition/separation of the substrate 10. The gap is defined between the second coupling and feeding portion 26 and the radiating portion 22 due to the partition/separation of the substrate 10. The radiating portion 22 is designed in a proper length. Therefore, current under a specific frequency can be coupled to the radiating portion 22 by the coupling part 245 of the first coupling and feeding portion 24, and the radiating portion 22 can generate radiation and resonance.

Thus, current through the second coupling and feeding portion 26 from the first coupling and feeding portion 24 through direct coupling and current through the coupling and feeding portion 24 from the coupling and feeding portion 26 through direct coupling are greatly reduced to improve isolation between the first coupling and feeding portion 24 and the second coupling and feeding portion 26. Accordingly, less current from one coupling and feeding portion can be fed to the other coupling and feeding portion in the near field through electromagnetic coupling to reach maximum isolation and greatly ameliorates radiating performance of the first antenna 20. According to above description about how the first antenna works, it is noted that the first antenna 20 can be used to design multi-band antenna by multiple branch paths.

The grounding portion 28 is located on the first surface 102 and the second surface 104 of the substrate 10.

Figure 4:
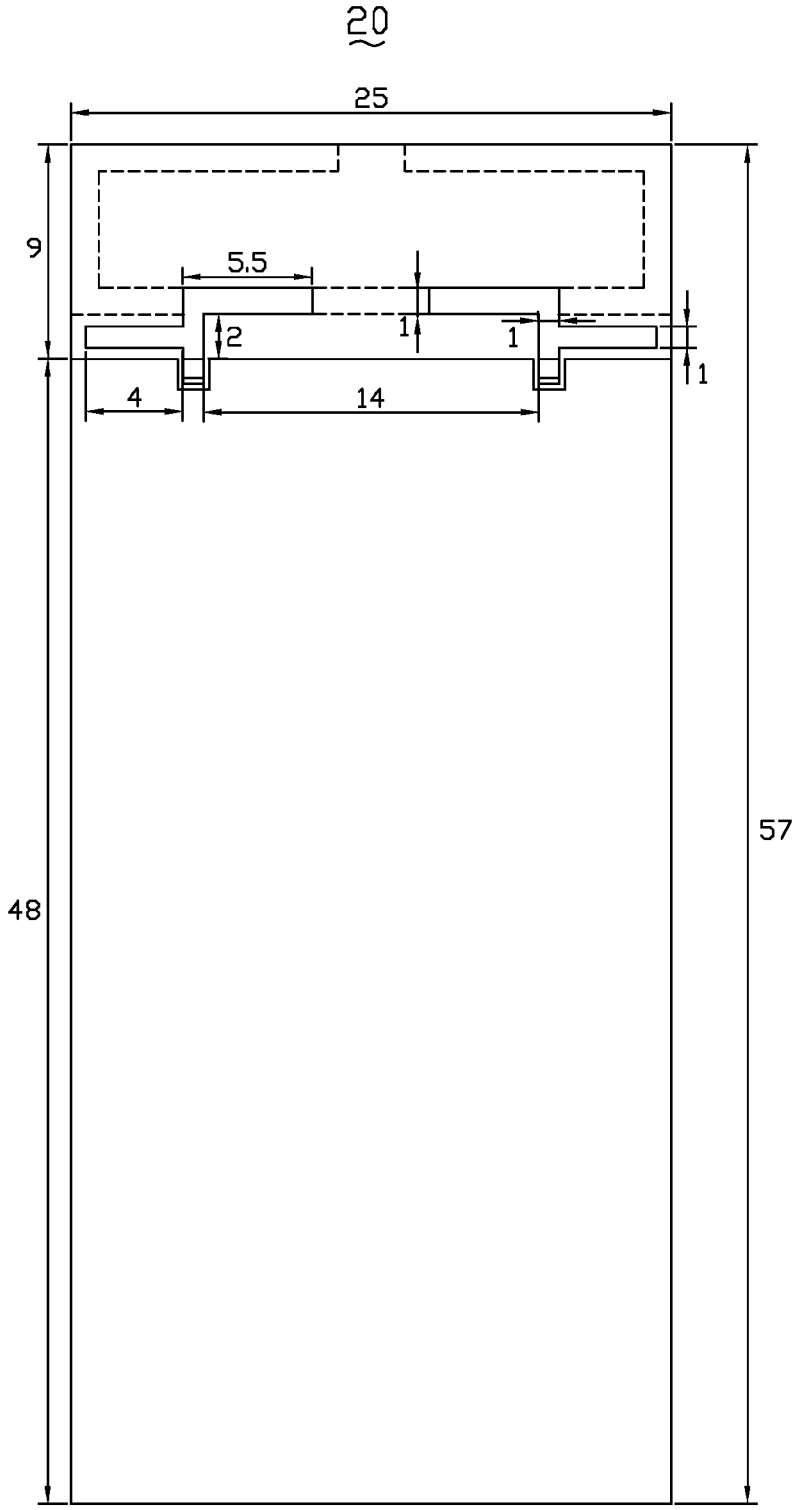
FIG. 4 shows a dimensional view of the first surface of the first antenna shown in FIG. 1 in accordance with the present disclosure.
Figure 5:
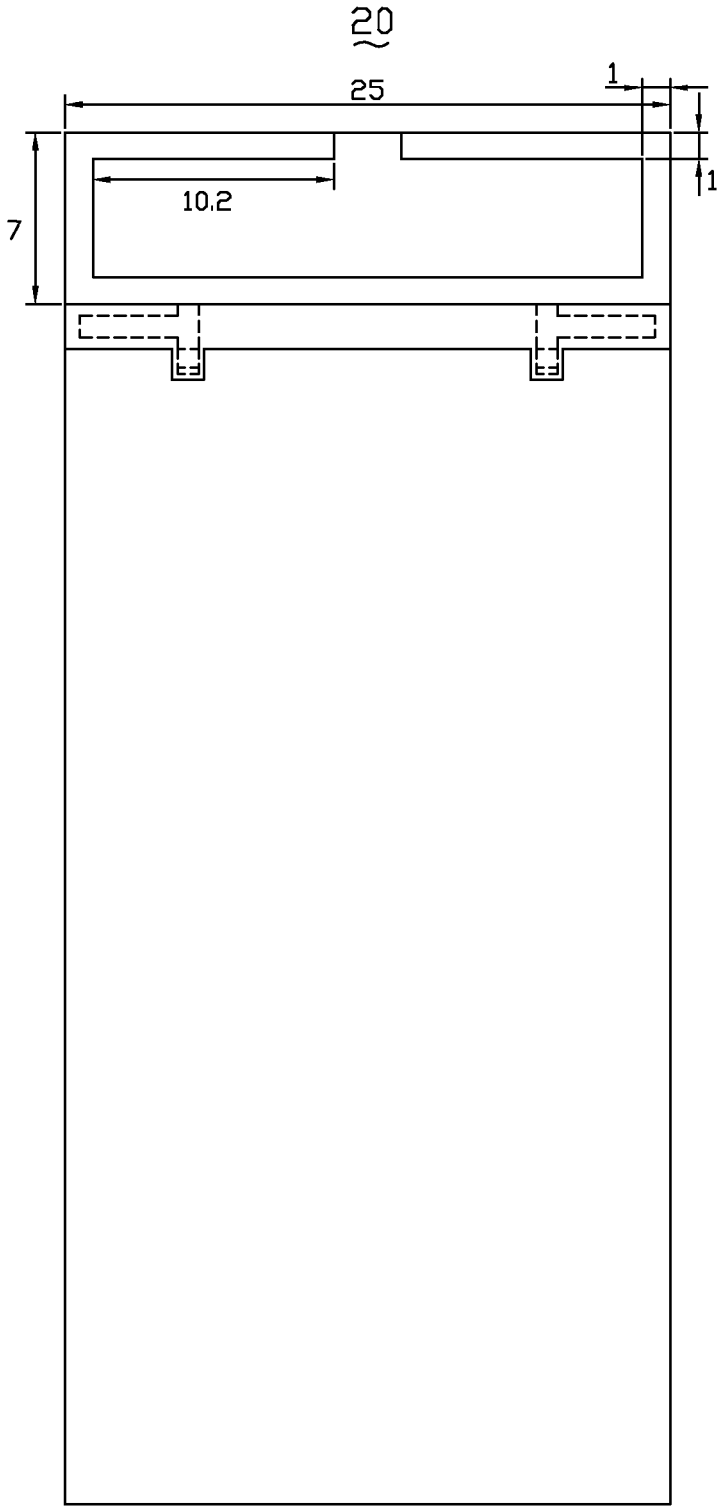
FIG. 5 shows a dimensional view of the second surface of the first antenna shown in FIG. 1 in accordance with the present disclosure.

FIG. 4 shows a dimensional view of the first surface 102 of the first antenna 20 shown in FIG. 1 in accordance with the present disclosure. FIG. 5 shows a dimensional view of the second surface 104 of the first antenna 20 shown in FIG. 1 in accordance with the present disclosure.

In the exemplary embodiment, length, width and thickness of the substrate 10 are about 57 millimeters (mm), 25 mm and 1 mm, respectively. Length and width of the grounding portion 28 on the first surface 102 and the second surface 104 are about 48 mm and 25 mm, respectively. Length and width of the first radiating part 221 of the radiating portion 22 are about 17.2 mm and 1 mm, respectively. Length and width of the second radiating part 223 of the radiating portion 22 are about 17.2 mm and 1 mm, respectively. Length and width of the second radiating part 225 of the radiating portion 22 are about 25 mm and 1 mm, respectively. Length and width of the first coupling unit 245*a* of the first coupling and feeding portion 24 are about 5.5 mm and 1 mm, respectively. Length and width of the second coupling unit 245*b* of the first coupling and feeding portion 24 are about 2 mm and 1 mm, respectively. Length and width of the third coupling unit 245*c* of the first coupling and feeding portion 24 are about 4 mm and 1 mm, respectively.

Dimensions of each part of the second coupling and feeding portion 26 is same as dimensions of each part of the second coupling and feeding portion 24. The gap between the second feeding part 241 of the first coupling and feeding portion 24 and the second coupling and feeding portion 26 is about 14 mm.

Figure 6:
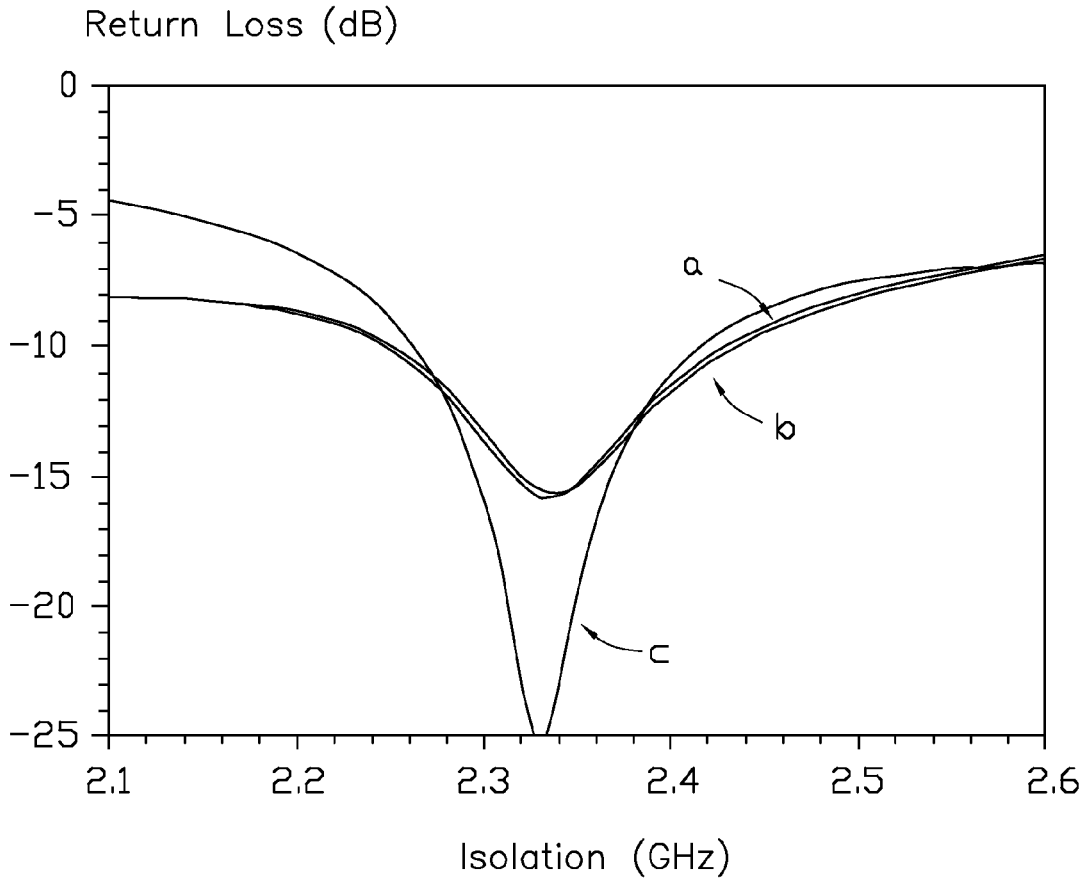
FIG. 6 shows a schematic view of one embodiment of return loss and isolation measurement for the first antenna shown in FIG. 1 in accordance with the present disclosure.

FIG. 6 shows a schematic view of one embodiment of return loss and isolation measurement for the first antenna 20 shown in FIG. 1 in accordance with the present disclosure.

As shown in FIG. 6, curve a and curve b represent the return loss for the first antenna coupling and feeding portion 24 and the second coupling and feeding portion 26 respectively, while curve c represents the isolation for the first antenna 20. The first antenna 20 is structurally symmetrical, so curve a is fundamentally the same as curve b.

The present disclosure enables the first antenna 20 to cover radio frequency bands 2.3 GHz-2.4 GHz under Long Term Evolution (LTE) over and achieves effects of the MIMO antenna which return loss attenuation is less than −10 decibels (dB), which is applicable to communication standards, provides better isolation and greatly ameliorates radiating performance of the first antenna 20.

Figure 7:
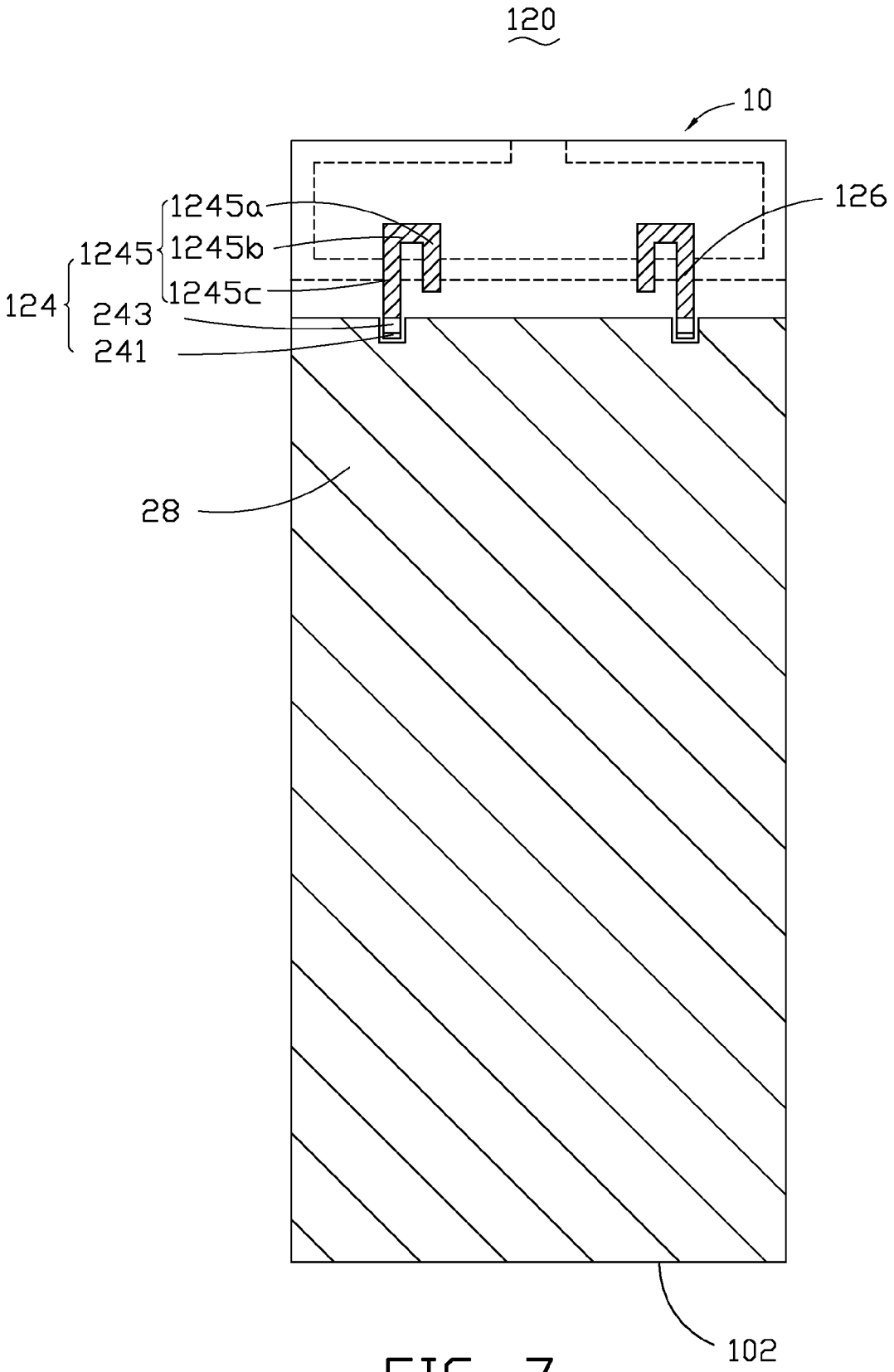
FIG. 7 shows a view of one embodiment of a first surface of a second antenna in accordance with the present disclosure.
Figure 8:
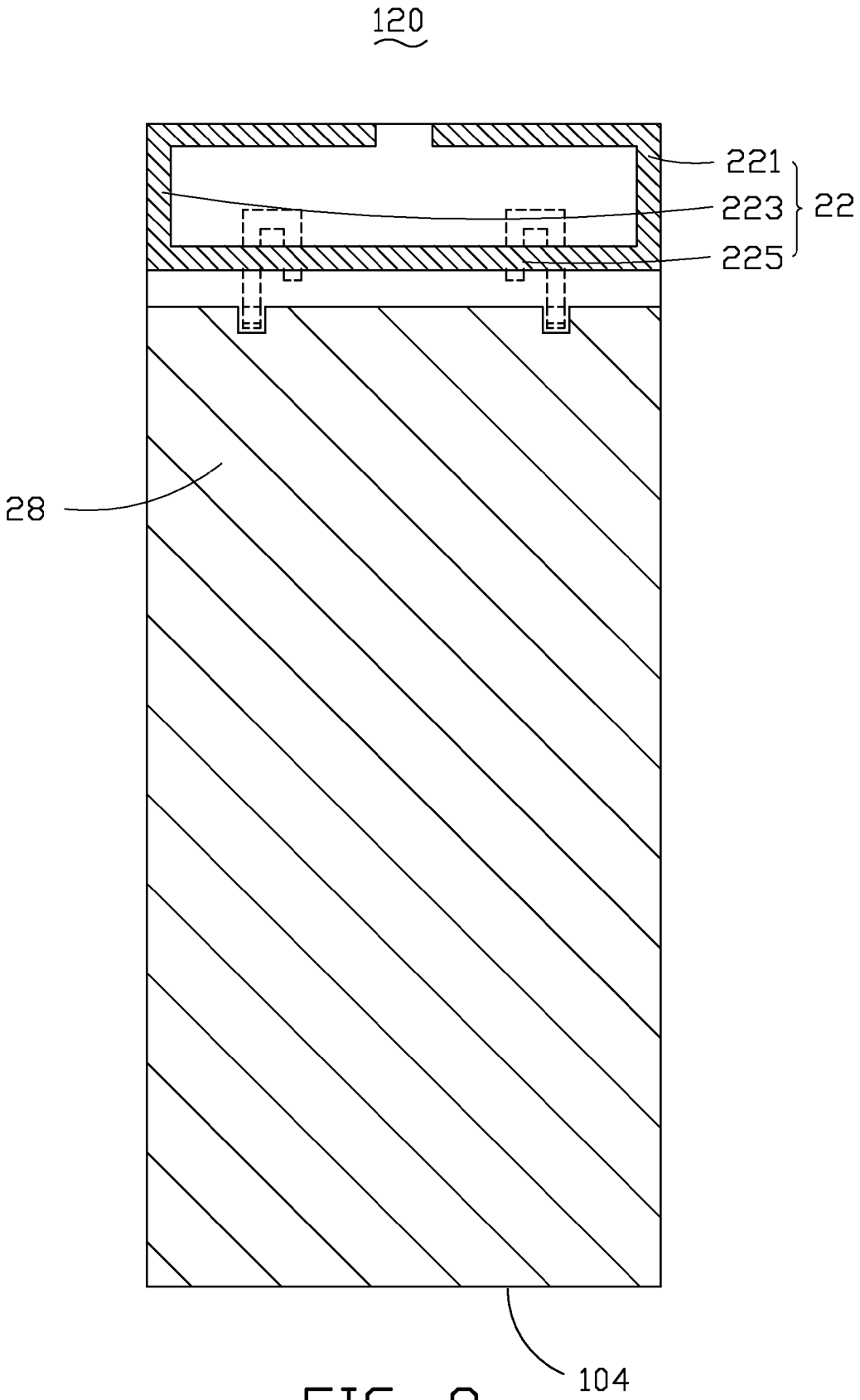
FIG. 8 shows a view of one embodiment of a second surface of the second antenna shown in FIG. 7 in accordance with the present disclosure.

FIG. 7 shows a view of one embodiment of a first surface 102 of a second antenna 120 in accordance with the present disclosure. FIG. 8 shows a view of one embodiment of a second surface 104 of the second antenna 120 shown in FIG. 7 in accordance with the present disclosure. In one embodiment, the second antenna 120 differs from the first antenna 20 shown in FIG. 1 that the shape of the first coupling and feeding portion 24 of the first antenna 20 is adjusted to form a first coupling and feeding portion 124 of the second antenna 120 as shown in FIG. 7, and the shape of the second coupling and feeding portion 26 of the first antenna 20 is adjusted to form a second coupling and feeding portion 126 of the second antenna 120 as shown in FIG. 7.

In one embodiment, the second antenna 120 is located on a substrate 10. The substrate 10 may be a printed circuit board (PCB) and includes a first surface 102 and a second surface 104 opposite to the first surface 102.

The second antenna 120 includes a radiating portion 22, a first coupling and feeding portion 124, a second coupling and feeding portion 126, and a grounding portion 28. Each of the dimensional and the position and the shape of the radiating portion 22 and the grounding portion 28 of the second antenna 120 is the same as that of the first antenna 20 as shown in FIG. 1.

The first coupling and feeding portion 124 is located on the first surface 102 of the substrate 10 and includes a feeding part 241, a matching part 243 and a coupling part 1245. The feeding part 241 and the matching part 243 of the second antenna 120 is the same as that of the first antenna 20 as shown in FIG. 1. The coupling part 1245 includes an elongated first coupling unit 1245*a*, an elongated second coupling unit 1245*b* and an elongated third coupling unit 1245*c*.

One end of the first coupling unit 1245*a* is perpendicularly connected to the second coupling unit 1245*b* while the other end outwardly extend away from the radiating portion 22, one end of the third coupling unit 1245*c* is perpendicularly connected to the second coupling unit 1245*b* while the other end outwardly extend away from the radiating portion 22, length of the first coupling unit 1245*a* is less than length of the third coupling unit 1245*c*.

In one embodiment, the second coupling unit 1245*b* is located on inside of a projection of the radiating portion 22 projected on the first surface 102 of the substrate 10 and is parallel to the third radiating part 225. A projection of the third radiating part 225 on the first surface 102 overlaps with the first coupling unit 1245*a* and the third coupling unit 1245*c*. A gap defined between the third radiating part 225 and the first coupling unit 1245*a* is due to a partition/separation of the substrate 10. A gap is defined between the third radiating part 22 and the third coupling unit 1245*c* due to the partition/separation of the substrate 10. Therefore, current under a specific frequency can be coupled to the radiating portion 22 by the coupling part 1245 of the first coupling and feeding portion 124, and the radiating portion 22 can generate radiation and resonance. Thus, current through the second coupling and feeding portion 126 from the first coupling and feeding portion 124 through direct coupling and current through the coupling and feeding portion 124 from the coupling and feeding portion 126 through direct coupling are greatly reduced to improve isolation between the first coupling and feeding portion 124 and the second coupling and feeding portion 126.

It is noted that the coupling part 1245 of the first coupling and feeding portion 124 of the second antenna 120 can be any type of meandering patterns.

In one embodiment, the first coupling and feeding portion 124 has a structure symmetrical structure to the second coupling and feeding portion 126, and the first coupling and feeding portion 124 and the second coupling and feeding portion 126 are defined in axial symmetry and share the same axis of symmetry with the radiating portion 22.

Figure 9:
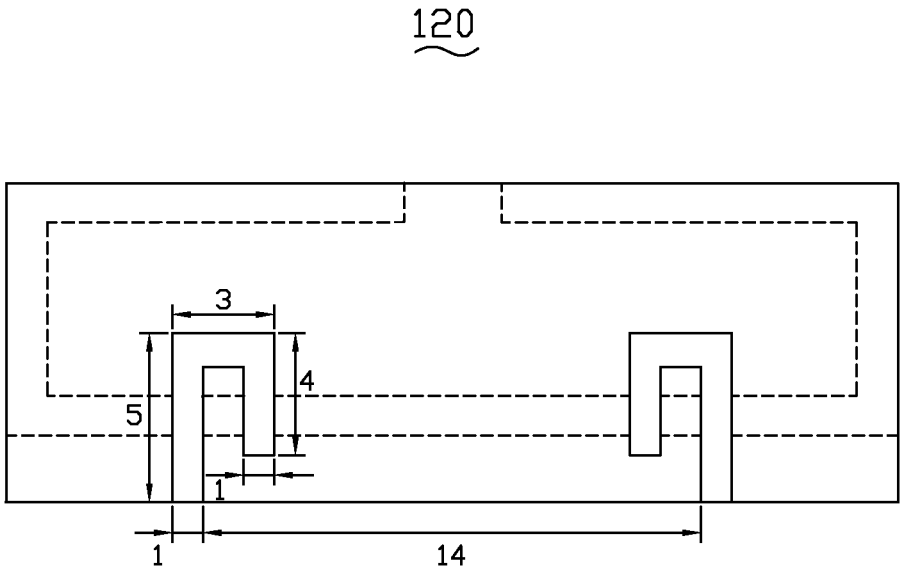
FIG. 9 shows a dimensional view of the coupling and feeding portion of the second antenna shown in FIG. 7 in accordance with the present disclosure.

FIG. 9 shows a dimensional view of the coupling and feeding portion 124 and 126 of the second antenna 120 shown in FIG. 7 in accordance with the present disclosure.

In one embodiment, length and width of the first coupling unit 1245*a* of the first coupling and feeding portion 124 are about 4 millimeters (mm) and 1 mm, respectively. Length and width of the second coupling unit 1245*b* of the first coupling and feeding portion 124 are about 5 mm and 1 mm, respectively. Length and width of the third coupling unit 1245*c* of the first coupling and feeding portion 124 are about 5 mm and 1 mm, respectively.

Dimensions of each part of the second coupling and feeding portion 126 is same as dimensions of each part of the second coupling and feeding portion 124. The gap between the third coupling unit 1245*c* of the first coupling and feeding portion 124 and the second coupling and feeding portion 126 is about 14 mm.

Figure 10:
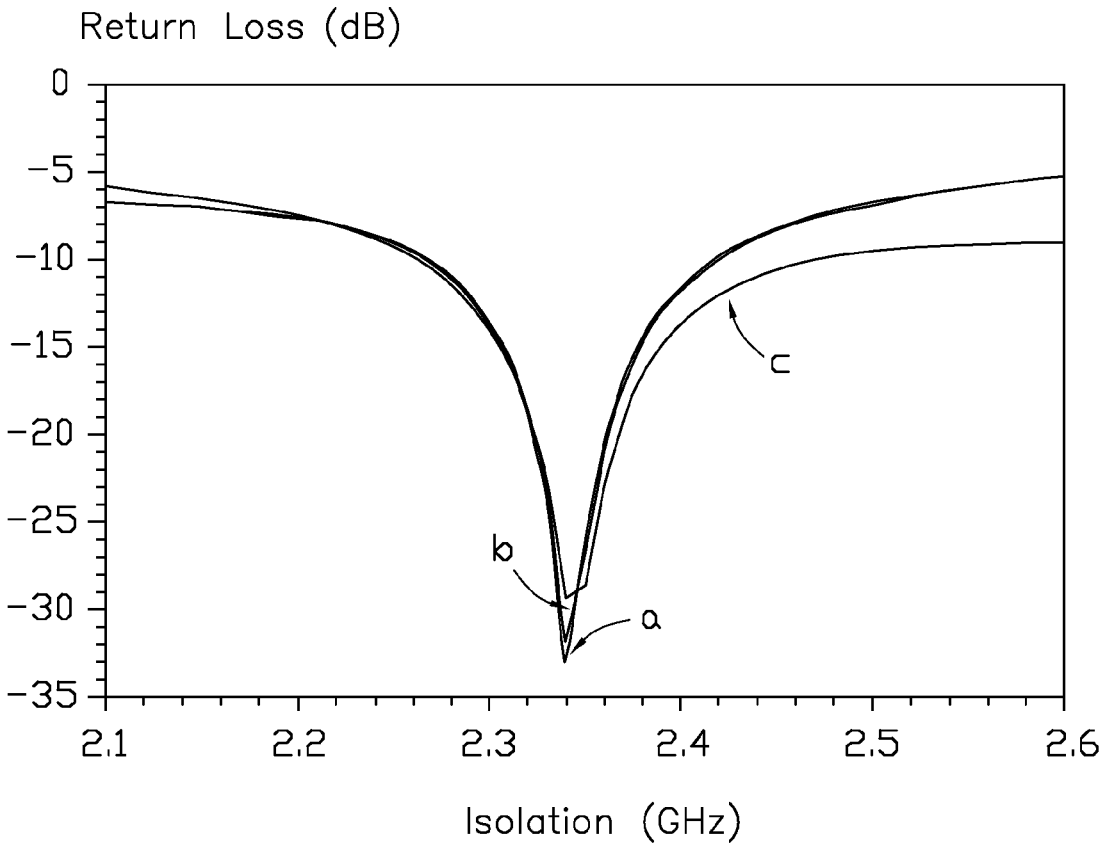
FIG. 10 shows a schematic view of one embodiment of return loss and isolation measurement for the second antenna shown in FIG. 7 in accordance with the present disclosure.

FIG. 10 shows a schematic view of one embodiment of return loss and isolation measurement for the second antenna 120 shown in FIG. 7 in accordance with the present disclosure.

As shown in FIG. 10, curve a and curve b represent the return loss for the first antenna coupling and feeding portion 124 and the second coupling and feeding portion 126 respectively, while curve c represents the isolation for the second antenna 120. The second antenna 120 is structurally symmetrical, so curve a is fundamentally the same as curve b. The present disclosure enables the second antenna 120 to cover radio frequency bands 2.3 GHz-2.4 GHz under Long Term Evolution (LTE) over and achieves effects of the MIMO antenna which return loss attenuation is less than −10 decibels (dB), which is applicable to communication standards, provides better isolation and greatly ameliorates radiating performance of the second antenna 120.

Figure 11:
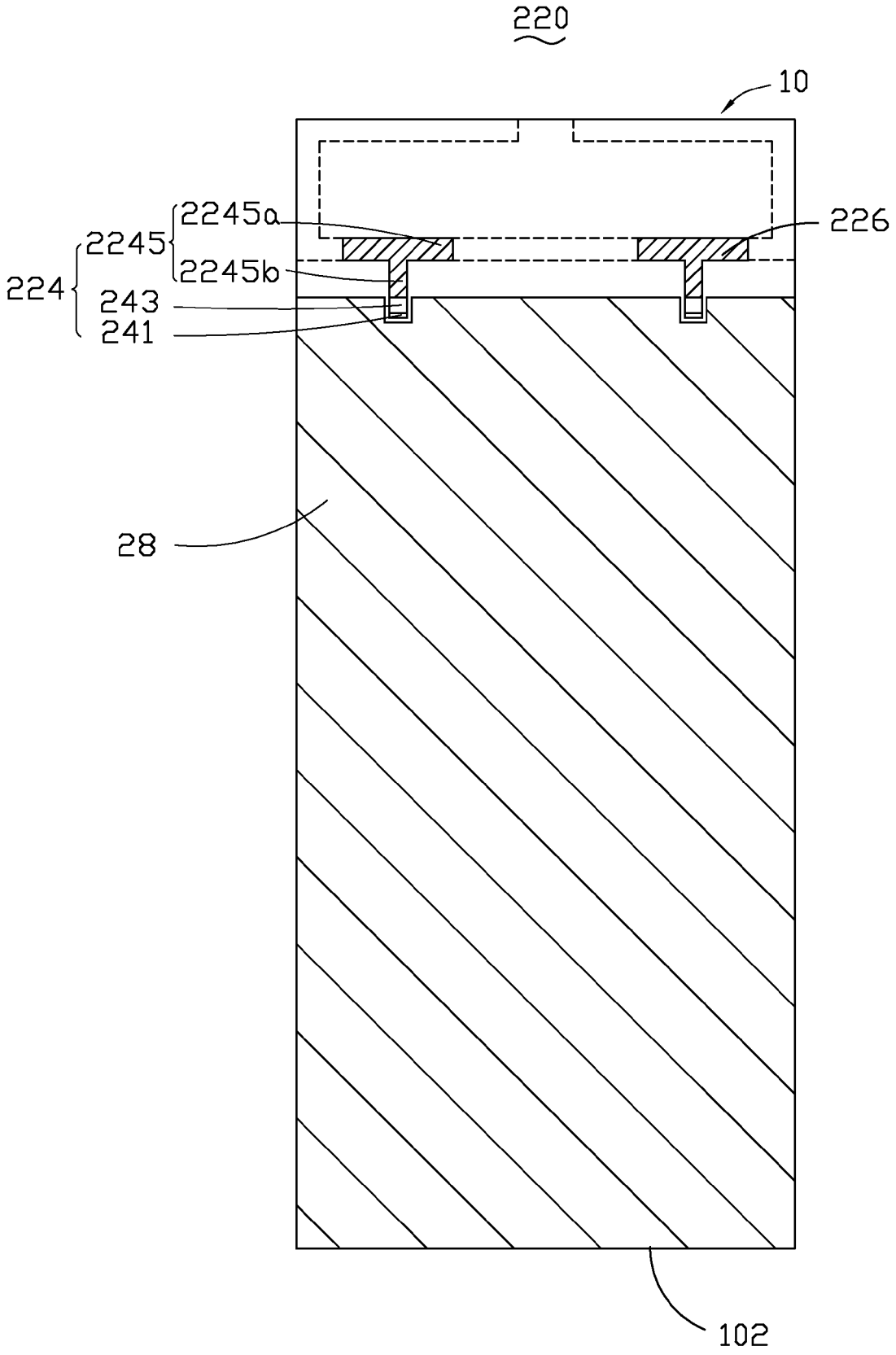
FIG. 11 shows a view of one embodiment of a first surface of a third antenna in accordance with the present disclosure.
Figure 12:
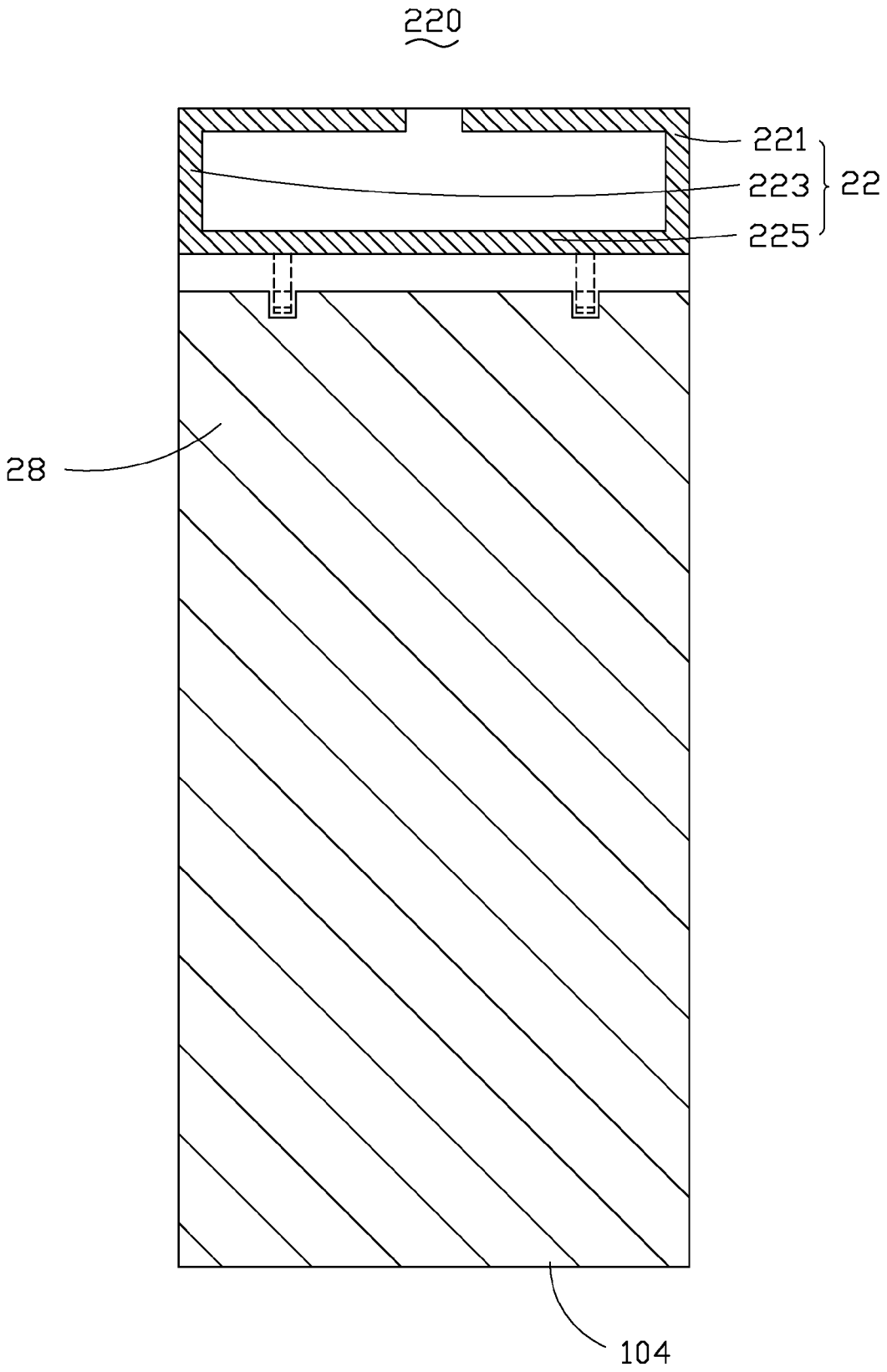
FIG. 12 shows a view of one embodiment of a second surface of the third antenna shown in FIG. 11 in accordance with the present disclosure.

FIG. 11 shows a view of one embodiment of a first surface 102 of a third antenna 220 in accordance with the present disclosure. FIG. 12 shows a view of one embodiment of a second surface 104 of the third antenna 220 shown in FIG. 11 in accordance with the present disclosure. In one embodiment, the third antenna 220 differs from the first antenna 20 shown in FIG. 1 and FIG. 2 that the shape of the first coupling and feeding portion 24 of the first antenna 20 is adjusted to form a first coupling and feeding portion 224 of the third antenna 220 as shown in FIG. 11, and the shape of the second coupling and feeding portion 26 of the first antenna 20 is adjusted to form a second coupling and feeding portion 226 of the third antenna 220 as shown in FIG. 11.

In one embodiment, the third antenna 220 is located on a substrate 10. The substrate 10 may be a printed circuit board (PCB) and includes a first surface 102 and a second surface 104 opposite to the first surface 102.

The third antenna 220 includes a radiating portion 22, a first coupling and feeding portion 224, a second coupling and feeding portion 226, and a grounding portion 28. Each of the dimensional and the position and the shape of the radiating portion 22 and the grounding portion 28 of the third antenna 220 is the same as that of the first antenna 20 as shown in FIG. 1.

The first coupling and feeding portion 224 is located on the first surface 102 of the substrate 10 and includes a feeding part 241, a matching part 243 and a coupling part 2245. The feeding part 241 and the matching part 243 of the third antenna 220 is the same as that of the first antenna 20 as shown in FIG. 1.

The coupling part 2245 includes an elongated first coupling unit 2245*a*, and an elongated second coupling unit 2245*b*. In one embodiment, the second coupling unit 2245*b* and the first coupling unit 2245*a* are connected and collectively form a "T" shape, wherein one end of the second coupling unit 2245*b* is perpendicularly connected to middle of the first coupling unit 2245*a* and another end of the second coupling unit 2245*b* is connected to the matching part 243.

In one embodiment, a projection of the third radiating part 225 on the first surface 102 overlaps with the first coupling unit 2245*a*. A gap is defined between the third radiating part 225 and the first coupling unit 2245*a* due to a partition/substrate. Therefore, current under a specific frequency can be coupled to the radiating portion 22 by the coupling part 2245 of the first coupling and feeding portion 224, and the radiating portion 22 can generate radiation and resonance. Thus, current through the second coupling and feeding portion 226 from the first coupling and feeding portion 224 through direct coupling and current through the coupling and feeding portion 224 from the coupling and feeding portion 226 through direct coupling are greatly reduced to improve isolation between the first coupling and feeding portion 224 and the second coupling and feeding portion 226. It is noted that the coupling part 2245 of the first coupling and feeding portion 224 of the third antenna 220 can be any type of meandering patterns.

In one embodiment, the first coupling and feeding portion 224 has a structure symmetrical structure to the second coupling and feeding portion 226, and the first and second coupling and feeding portions 224 and 226 are defined in axial symmetry and shares the same axis of symmetry with the radiating portion 22.

Figure 13:
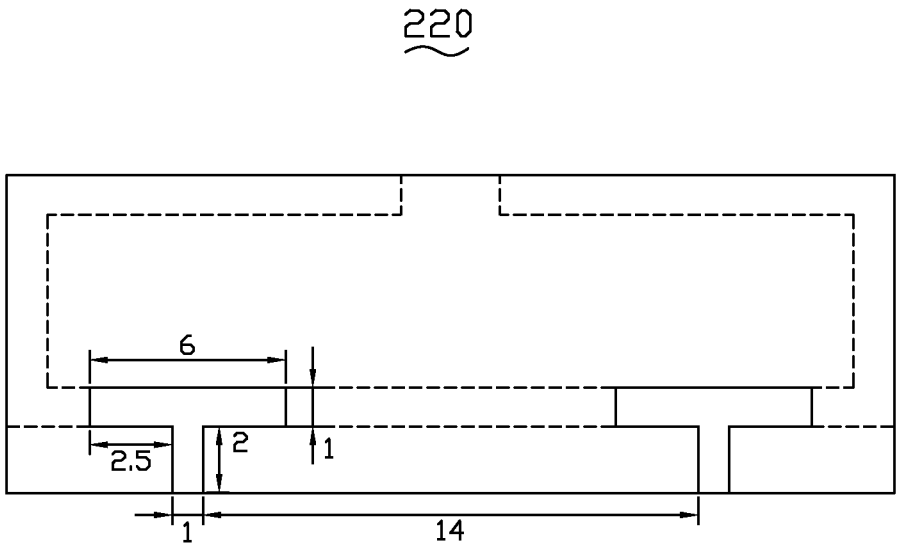
FIG. 13 shows a dimensional view of the coupling and feeding portion of the third antenna shown in FIG. 11 in accordance with the present disclosure.

FIG. 13 shows a dimensional view of the coupling and feeding portion 224 and 226 of the third antenna 220 shown in FIG. 11 in accordance with the present disclosure.

In one embodiment, length and width of the first coupling unit 2245*a* of the first coupling and feeding portion 224 are about 6 millimeters (mm) and 1 mm, respectively. Length and width of the second coupling unit 2245*b* of the first coupling and feeding portion 224 are about 2 mm and 1 mm, respectively. The distance between one end of the second coupling unit 2245*b* and the junction between the first coupling unit 2245*a* and the second coupling unit 2245*b* is about 2.5 mm.

Dimensions of each part of the second coupling and feeding portion 226 is same as dimensions of each part of the second coupling and feeding portion 224. The gap between the second coupling unit 2245*b* of the first coupling and feeding portion 224 and the second coupling and feeding portion 226 is about 14 mm.

Figure 14:
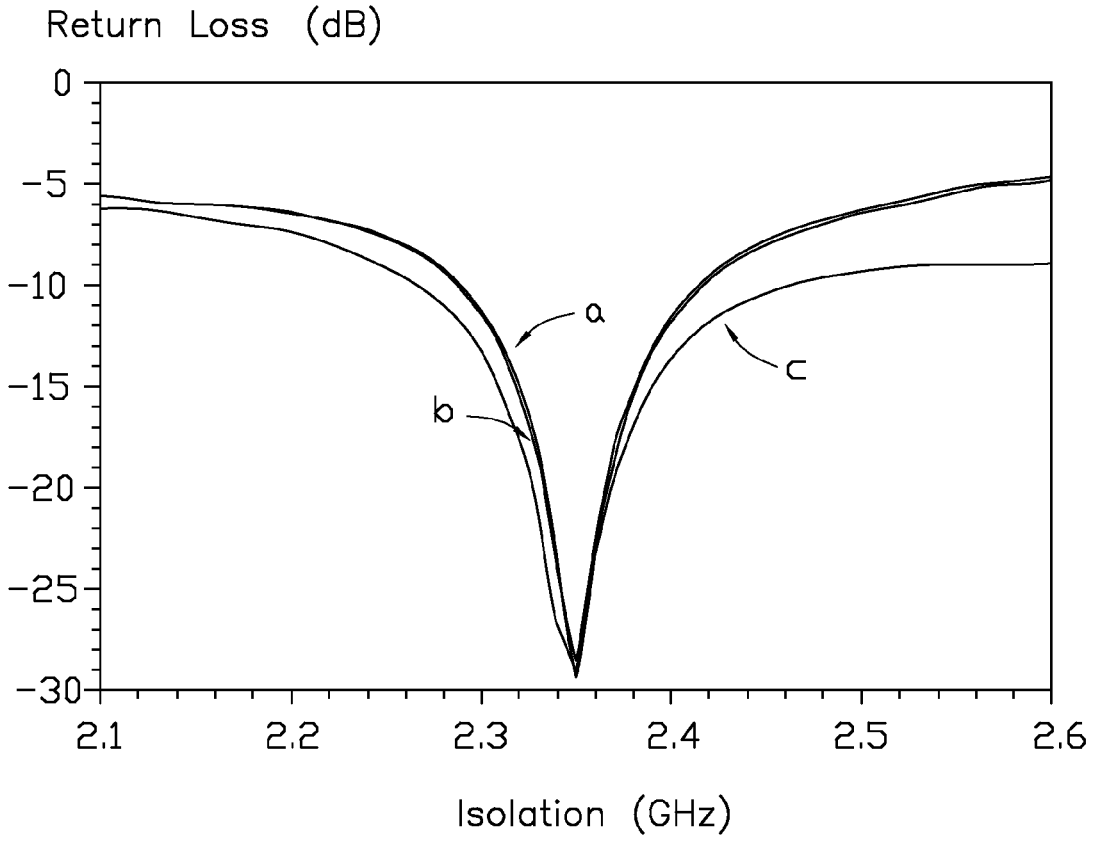
FIG. 14 shows a schematic view of one embodiment of return loss and isolation measurement for the third antenna shown in FIG. 11 in accordance with the present disclosure.

FIG. 14 shows a schematic view of one embodiment of return loss and isolation measurement for the third antenna 220 shown in FIG. 11 in accordance with the present disclosure.

As shown in FIG. 14, curve a and curve b represent the return loss for the first antenna coupling and feeding portion 224 and the second coupling and feeding portion 226 respectively, while curve c represents the isolation for the third antenna 220. The third antenna 220 is structurally symmetrical, so curve a is fundamentally the same as curve b. The present disclosure enables the third antenna 220 to cover radio frequency bands 2.3 GHz-2.4 GHz under Long Term Evolution (LTE) over and achieves effects of the MIMO antenna which return loss attenuation is less than −10 decibels (dB), which is applicable to communication standards, provides better isolation and greatly ameliorates radiating performance of the third antenna 220.

Figure 15:
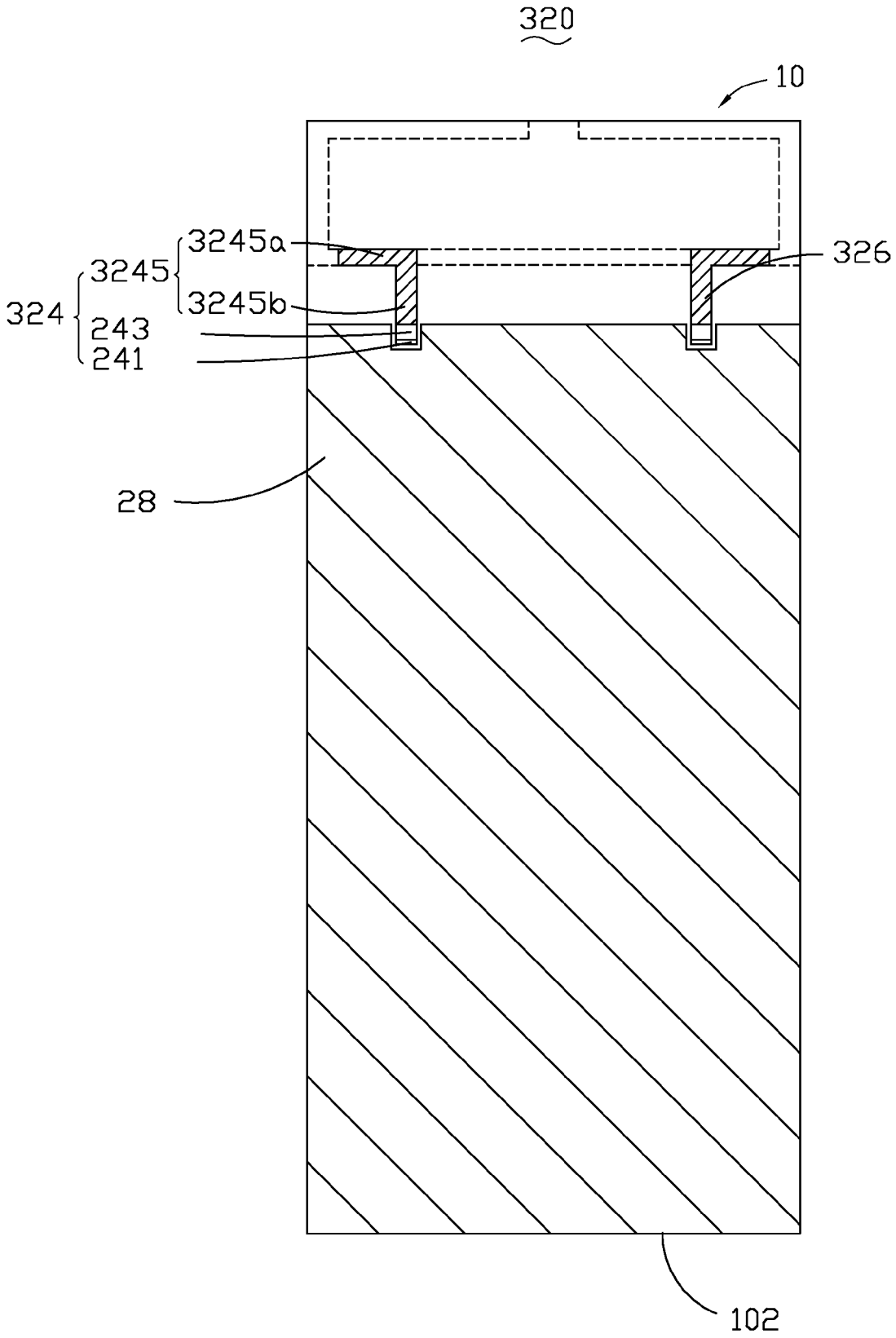
FIG. 15 shows a view of one embodiment of a first surface of a fourth antenna in accordance with the present disclosure.
Figure 16:
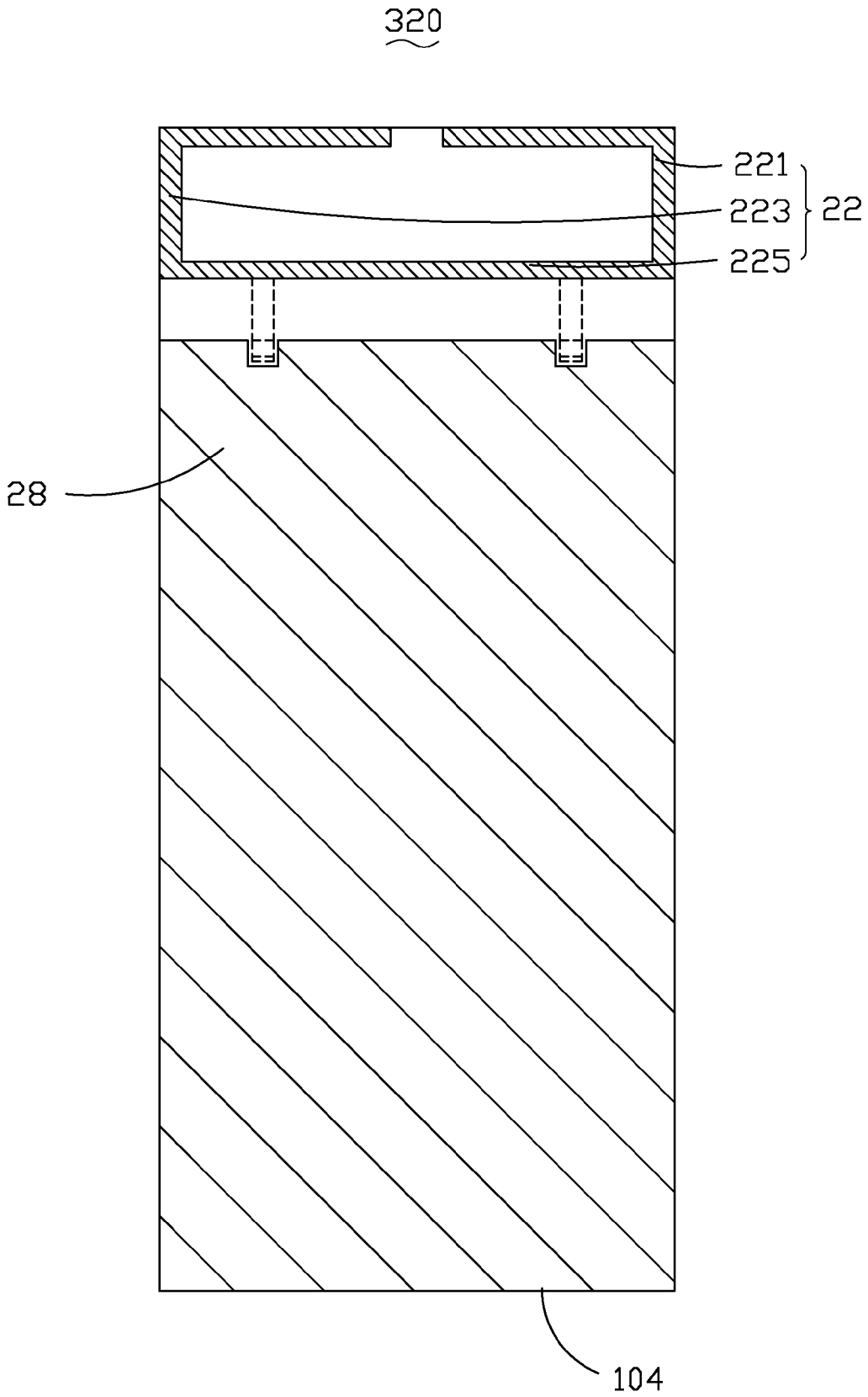
FIG. 16 shows a view of one embodiment of a second surface of the fourth antenna shown in FIG. 15 in accordance with the present disclosure.

FIG. 15 shows a view of one embodiment of a first surface 102 of a fourth antenna 320 in accordance with the present disclosure. FIG. 16 shows a view of one embodiment of a second surface 104 of the fourth antenna 320 shown in FIG. 15 in accordance with the present disclosure. In one embodiment, the fourth antenna 320 differs from the first antenna 20 shown in FIG. 1 and FIG. 2 that the shape of the first coupling and feeding portion 24 of the first antenna 20 is adjusted to form a first coupling and feeding portion 324 of the fourth antenna 320 as shown in FIG. 15, and the shape of the second coupling and feeding portion 26 of the first antenna 20 is adjusted to form a second coupling and feeding portion 326 of the fourth antenna 320 as shown in FIG. 15.

In one embodiment, the fourth antenna 320 is located on a substrate 10. The substrate 10 may be a printed circuit board (PCB) and includes a first surface 102 and a second surface 104 opposite to the first surface 102.

The fourth antenna 320 includes a radiating portion 22, a first coupling and feeding portion 324, a second coupling and feeding portion 326, and a grounding portion 28. Each of the dimensional and the position and the shape of the radiating portion 22 and the grounding portion 28 of the fourth antenna 320 is the same as that of the first antenna 20 as shown in FIG. 1.

The first coupling and feeding portion 324 is located on the first surface 102 of the substrate 10 and includes a feeding part 241, a matching part 243 and a coupling part 3245. The feeding part 241 and the matching part 243 of the fourth antenna 320 is the same as that of the first antenna 20 as shown in FIG. 1.

The coupling part 3245 includes an elongated first coupling unit 3245*a*, and an elongated second coupling unit 3245*b*. In one embodiment, one end of the second coupling unit 2245*b* is perpendicularly connected to one end of the first coupling unit 3245*a*, while one end of the second coupling unit 3245*b* is electrically connected to the matching part 243. The first coupling unit 2245*a* and the second coupling unit 2245*b* are collectively forms an "L" shape.

In one embodiment, a projection of the third radiating part 225 on the first surface 102 overlaps with the first coupling unit 3245*a*. A gap is defined between the third radiating part 225 and the first coupling unit 3245 due to a partition/separation of the substrate 10. Therefore, current under a specific frequency can be coupled to the radiating portion 22 by the coupling part 3245 of the first coupling and feeding portion 324, and the radiating portion 22 can generate radiation and resonance. Thus, current through the second coupling and feeding portion 326 from the first coupling and feeding portion 324 through direct coupling and current through the coupling and feeding portion 324 from the coupling and feeding portion 326 through direct coupling are greatly reduced to improve isolation between the first coupling and feeding portion 324 and the second coupling and feeding portion 326.

It is noted that the coupling part 3245 of the first coupling and feeding portion 324 of the fourth antenna 320 can be any type of meandering patterns.

In one embodiment, the first coupling and feeding portion 324 has a structure symmetrical structure to the second coupling and feeding portion 326, and the first and second coupling and feeding portions 324 and 326 are defined in axial symmetry and shares the same axis of symmetry with the radiating portion 22.

Figure 17:
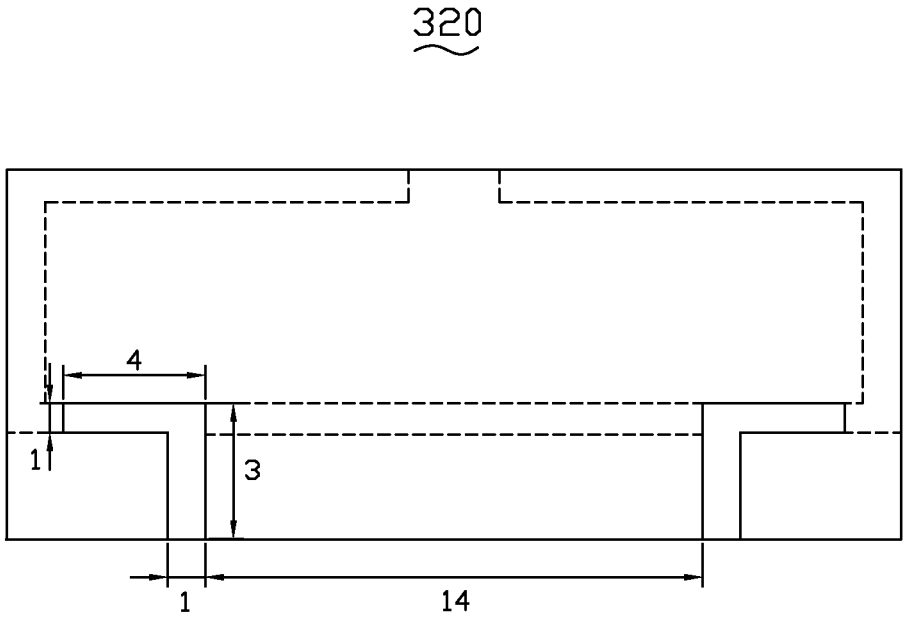
FIG. 17 shows a dimensional view of the coupling and feeding portion of the fourth antenna shown in FIG. 15 in accordance with the present disclosure.

FIG. 17 shows a dimensional view of the coupling and feeding portion 324 and 326 of the fourth antenna 320 shown in FIG. 15 in accordance with the present disclosure.

In one embodiment, length and width of the first coupling unit 3245*a* of the first coupling and feeding portion 324 are about 4 millimeters (mm) and 1 mm, respectively. Length and width of the second coupling unit 3245*b* of the fourth coupling and feeding portion 324 are about 3 mm and 1 mm, respectively.

Dimensions of each part of the second coupling and feeding portion 326 is same as dimensions of each part of the second coupling and feeding portion 324. The gap between the second coupling unit 3245*b* of the first coupling and feeding portion 324 and the second coupling and feeding portion 326 is about 14 mm.

Figure 18:
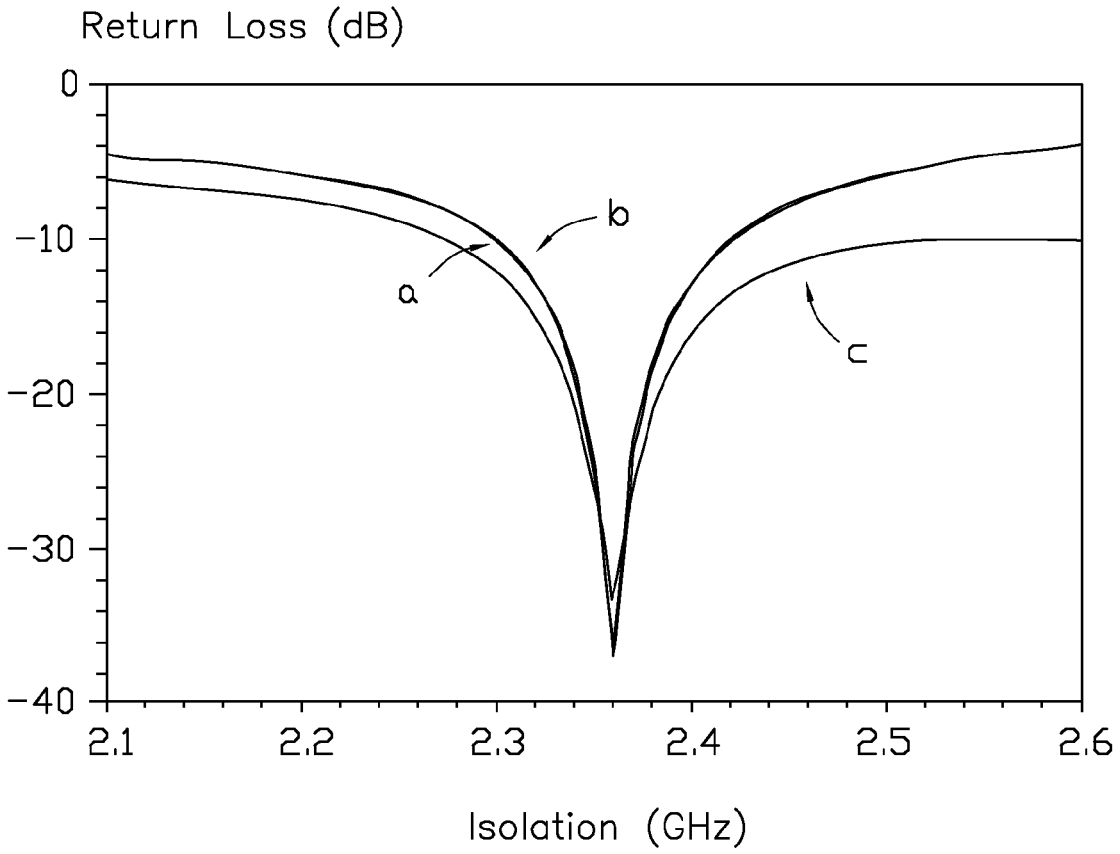
FIG. 18 shows a schematic view of one embodiment of return loss and isolation measurement for the fourth antenna shown in FIG. 15 in accordance with the present disclosure.

FIG. 18 shows a schematic view of one embodiment of return loss and isolation measurement for the fourth antenna 320 shown in FIG. 15 in accordance with the present disclosure.

As shown in FIG. 18, curve a and curve b represent the return loss for the first antenna coupling and feeding portion 324 and the second coupling and feeding portion 326 respectively, while curve c represents the isolation for the fourth antenna 320. The fourth antenna 320 is structurally symmetrical, so the curve a is fundamentally the same as the curve b. The present disclosure enables the fourth antenna 320 to cover radio frequency bands 2.3 GHz-2.4 GHz under Long Term Evolution (LTE) over and achieves effects of the MIMO antenna which return loss attenuation is less than −10 decibels (dB), which is applicable to communication standards, provides better isolation and greatly ameliorates radiating performance of the fourth antenna 320.

Figure 19:
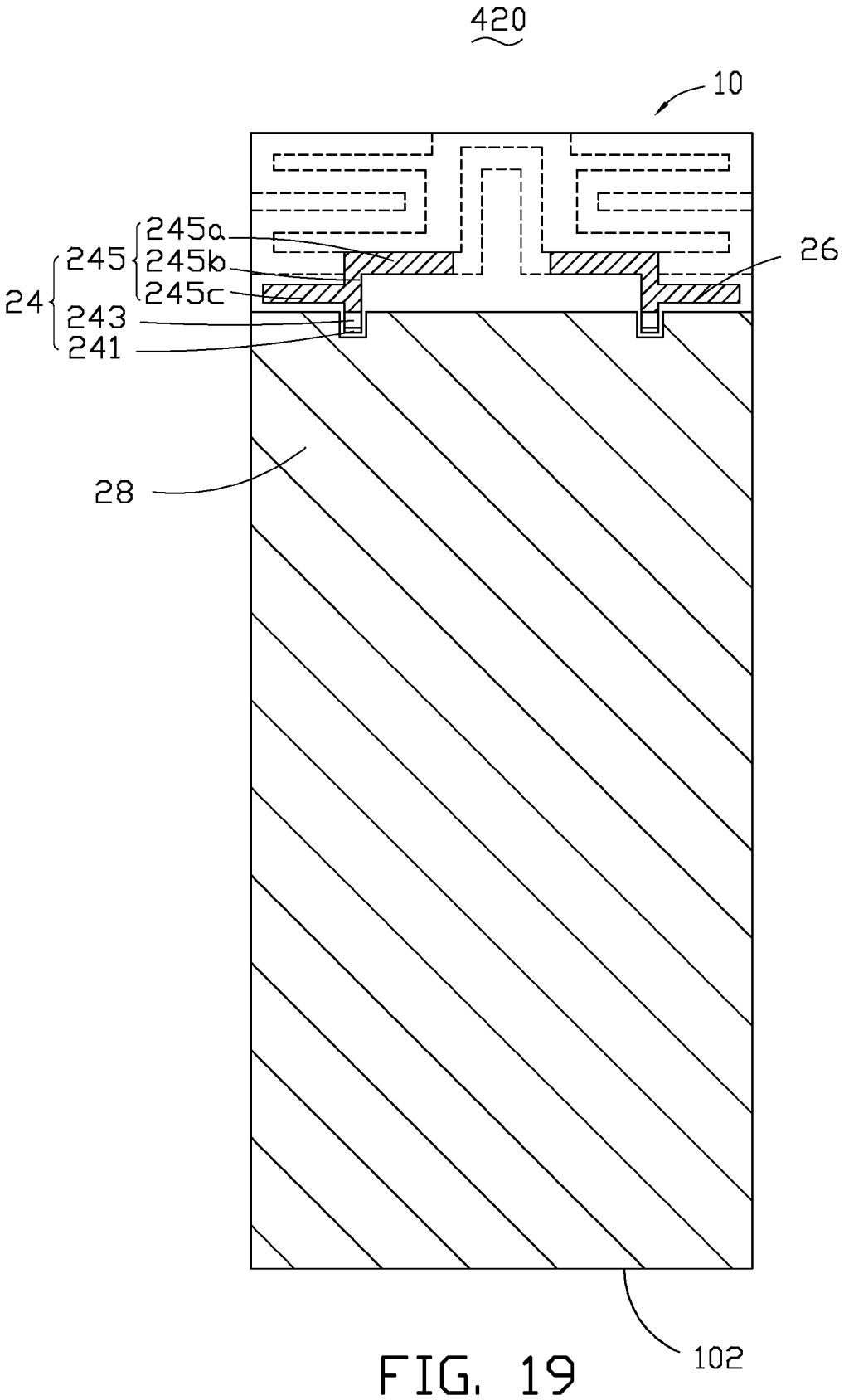
FIG. 19 shows a view of one embodiment of a first surface of a fifth antenna in accordance with the present disclosure.
Figure 20:
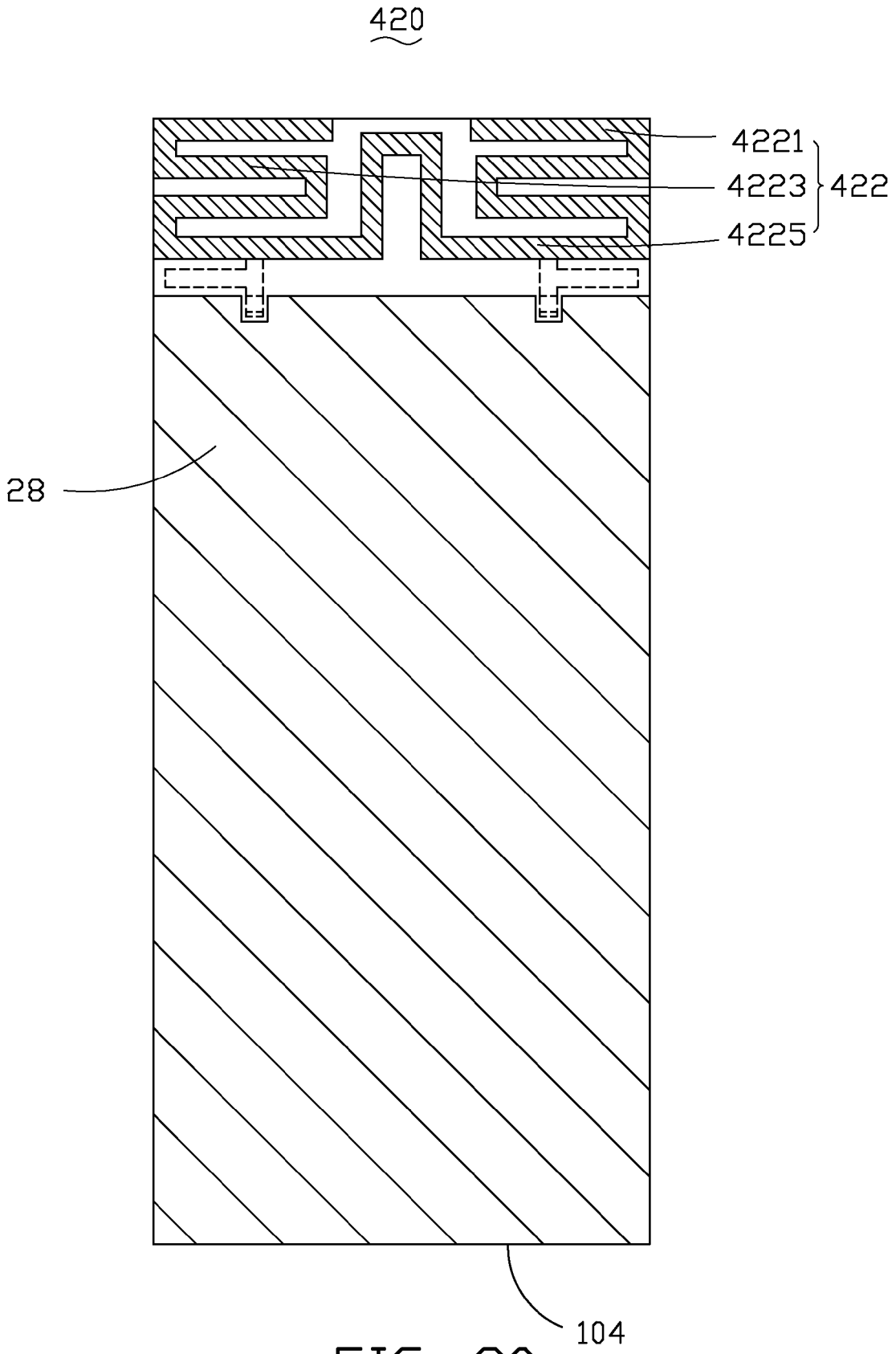
FIG. 20 shows a view of one embodiment of a second surface of the fifth antenna shown in FIG. 19 in accordance with the present disclosure.

FIG. 19 shows a view of one embodiment of a first surface 102 of a fifth antenna 420 in accordance with the present disclosure. FIG. 20 shows a view of one embodiment of a second surface 104 of the fifth antenna 420 shown in FIG. 19 in accordance with the present disclosure. In one embodiment, the fifth antenna 420 differs from the first antenna 20 shown in FIG. 1 and FIG. 2 that the shape of the radiating portion 22 is adjusted to form a radiating portion 422 of the fifth antenna 420 as shown in FIG. 20.

In one embodiment, the fifth antenna 420 is located on a substrate 10. The substrate 10 may be a printed circuit board (PCB) and includes a first surface 102 and a second surface 104 opposite to the first surface 102.

The fifth antenna 420 includes a radiating portion 422, a first coupling and feeding portion 24, a second coupling and feeding portion 26, and a grounding portion 28. Each of the dimensional and the position and the shape of the first coupling and feeding portion 24, the second coupling and feeding portion 26, and the grounding portion 28 of the fifth antenna 420 is the same as that of the first antenna 20 as shown in FIG. 1.

As shown in FIG. 20, the radiating portion 422 is located on the second surface 104 of the substrate 10 and radiates the electromagnetic signals from the first coupling and feeding portion 24 and the second coupling and feeding portion 26. In the embodiment, the radiating portion 422 is defined in axial symmetry and forms a meandering pattern with about $\lambda/2$ in length, wherein the $\lambda$ is a wavelength of the electromagnetic signals. It is noted that the radiating portion 422 may be in any type of meandering patterns.

In one embodiment, the radiating portion 422 includes a first radiating part 4221, a second radiating part 4223, and a third radiating part 4225. In the exemplary embodiment, the first radiating part 4221, the third radiating part 4225, and the second radiating part 4223 are connected in series and collectively form the meandering pattern.

In one embodiment, each of the first radiating part 4221 and the second radiating part 4223 has an "S" shape. The middle of the third radiating part 4225 has a "U" shape. The first radiating part 4221 and the second radiating part 4223 are defined in axial symmetry. One end of the third radiating part 4225 is perpendicularly connected to the first radiating part 4221 while the other end is perpendicularly connected to the second radiating part 4223.

Figure 21:
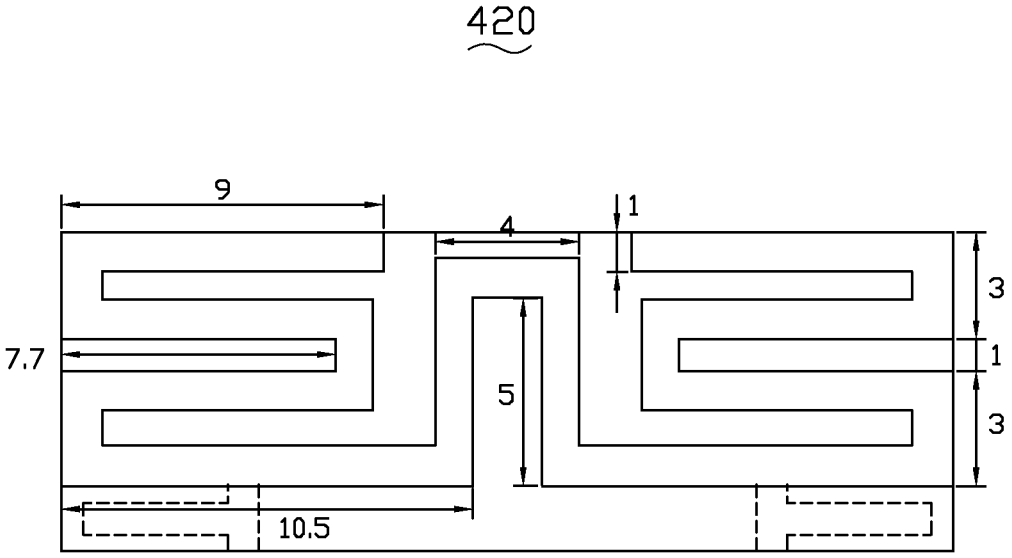
FIG. 21 shows a dimensional view of the radiating portion of the fifth antenna shown in FIG. 19 in accordance with the present disclosure.

FIG. 21 shows a dimensional view of the radiating portion of the fifth antenna 420 shown in FIG. 19 in accordance with the present disclosure.

In one embodiment, length and width of the first radiating part 4221 of the radiating portion 422 are about 9+3+7.7+3+7.7+3=33.4 millimeters (mm) and 1 mm, respectively. In one embodiment, length and width of the second radiating part 4223 of the radiating portion 422 is the same as that of the first radiating part 4221, respectively. In one embodiment, length and width of the third radiating part 4225 of the radiating portion 422 are about 10.5+5+4+5+10.5=35 mm and 1 mm, respectively.

Figure 22:
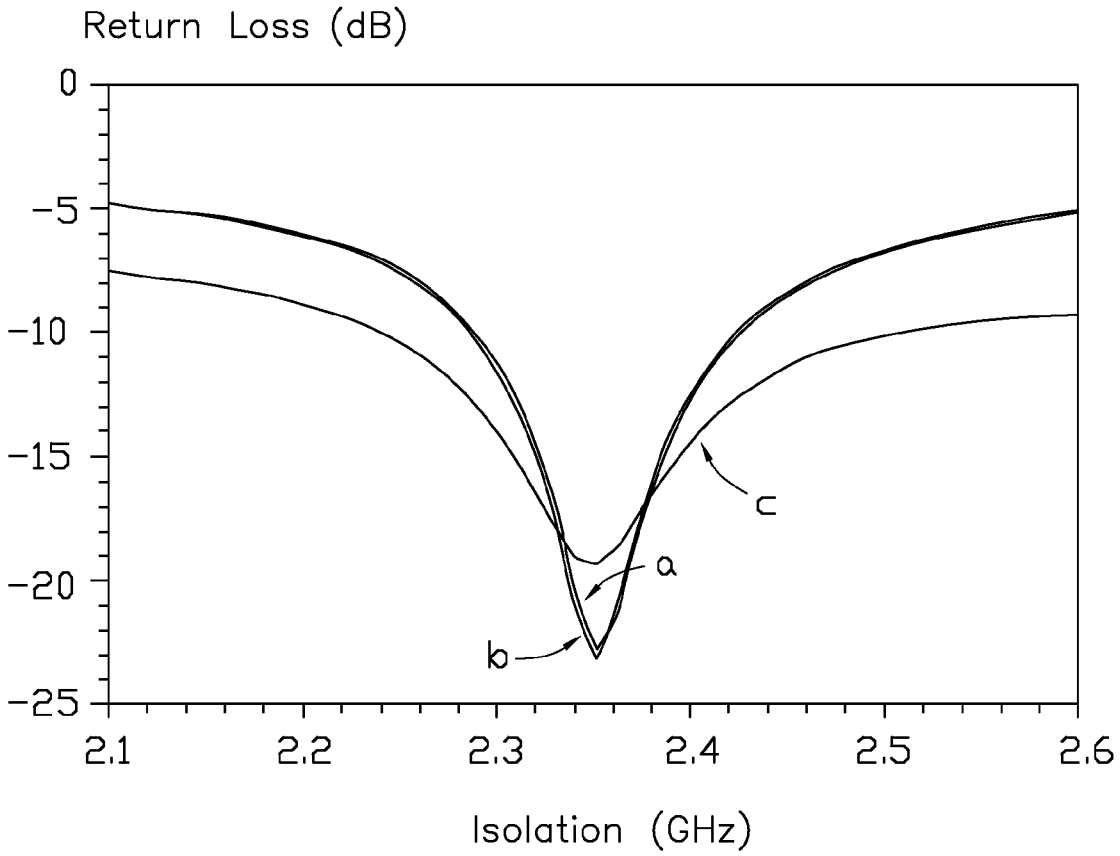
FIG. 22 shows a schematic view of one embodiment of return loss and isolation measurement for the fifth antenna shown in FIG. 19 in accordance with the present disclosure.

FIG. 22 shows a schematic view of one embodiment of return loss and isolation measurement for the fifth antenna 420 shown in FIG. 19 in accordance with the present disclosure.

As shown in FIG. 22, curve a and curve b represent the return loss for the first antenna coupling and feeding portion 424 and the second coupling and feeding portion 426 respectively, while curve c represents the isolation for the fifth antenna 420. The fifth antenna 420 is structurally symmetrical, so the curve a is fundamentally the same as the curve b. The present disclosure enables the fifth antenna 420 to cover radio frequency bands 2.3 GHz-2.4 GHz under Long Term Evolution (LTE) over and achieves effects of the MIMO antenna which return loss attenuation is less than −10 decibels (dB), which is applicable to communication standards, provides better isolation and greatly ameliorates radiating performance of the fifth antenna 420.

Figure 23:
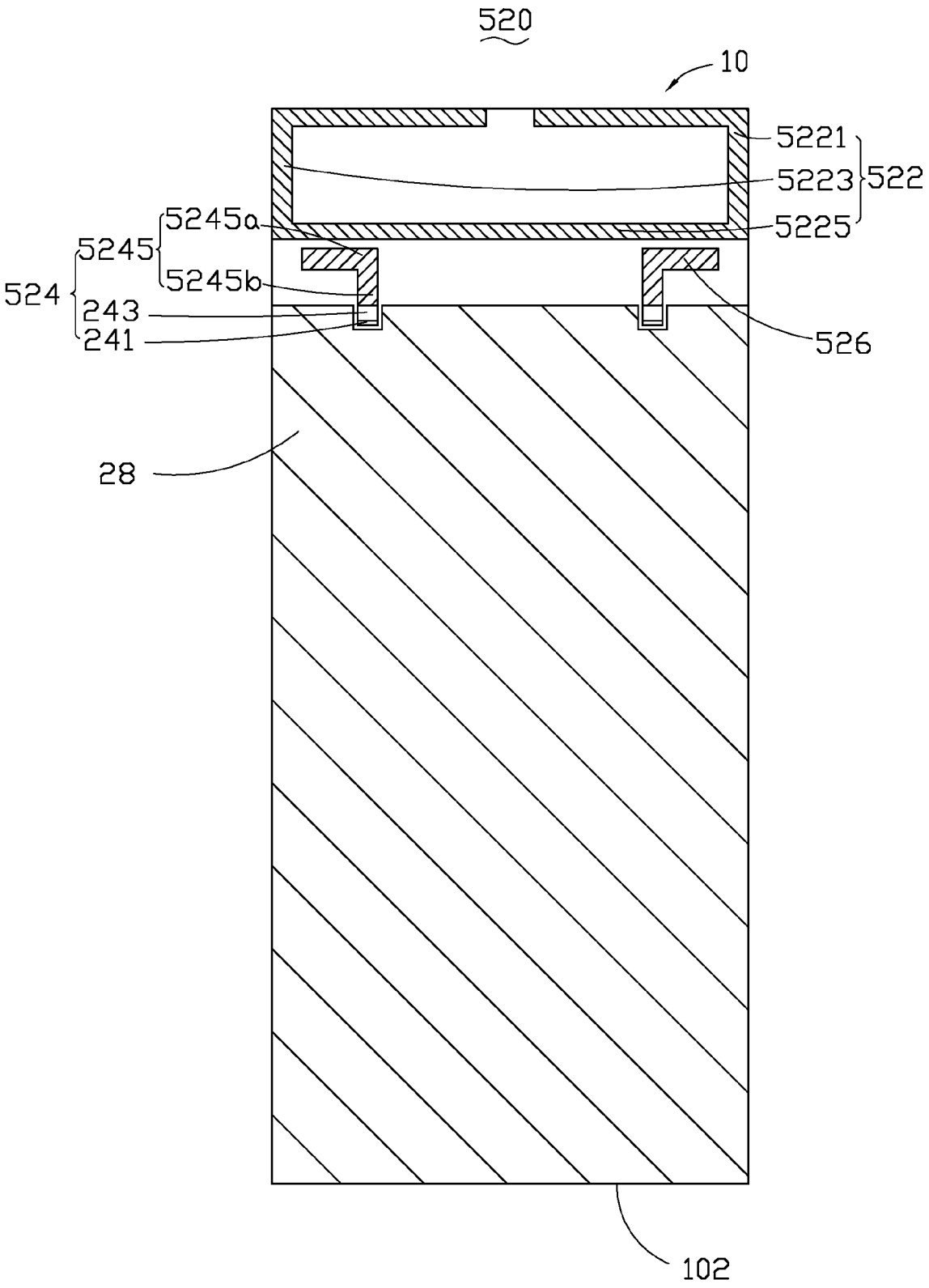
FIG. 23 shows a view of one embodiment of a first surface of a sixth antenna in accordance with the present disclosure.
Figure 24:
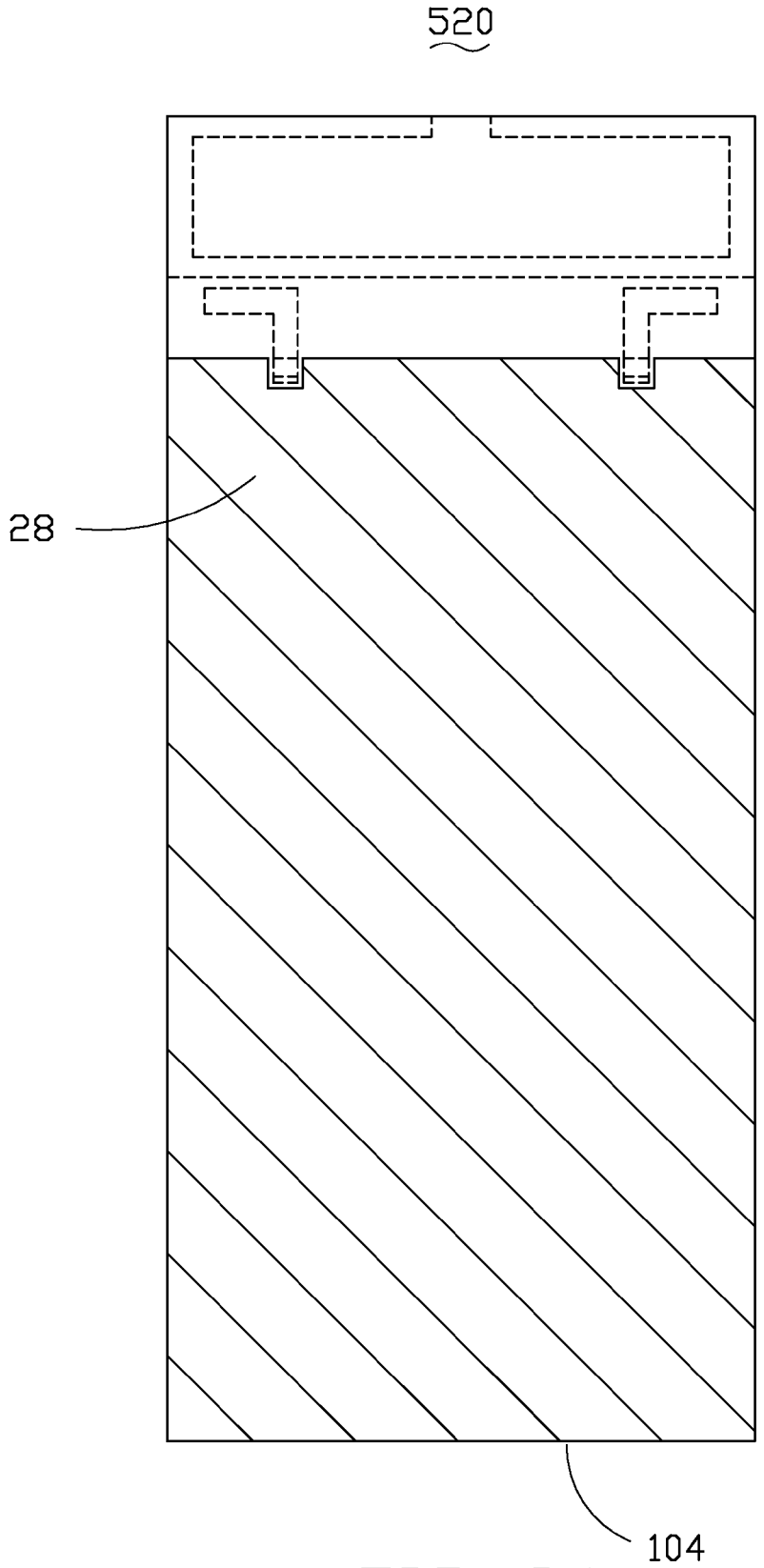
FIG. 24 shows a view of one embodiment of a second surface of the sixth antenna shown in FIG. 23 in accordance with the present disclosure.

FIG. 23 shows a view of one embodiment of a first surface 102 of a sixth antenna 520 in accordance with the present disclosure. FIG. 24 shows a view of one embodiment of a second surface 104 of the sixth antenna shown 520 in FIG. 23 in accordance with the present disclosure. In one embodiment, the sixth antenna 520 differs from the fourth antenna 320 shown in FIGS. 15 and 16 that the radiating portion 22 is moved from the second surface 104 to the first surface 102 to a radiating portion 522 of the sixth antenna 520, and the position relations among the radiating portion 522, the first coupling and feeding portion 524 and the second coupling and feeding portion 526 are changed.

In one embodiment, the sixth antenna 520 is located on a substrate 10. The substrate 10 may be a printed circuit board (PCB) and includes a first surface 102 and a second surface 104 opposite to the first surface 102.

The sixth antenna 520 includes a radiating portion 522, a first coupling and feeding portion 524, a second coupling and feeding portion 526, and a grounding portion 28. The each shape of the radiating portion 522, the first coupling and feeding portion 524, the second coupling and feeding portion, and the grounding portion 528 of the sixth antenna 520 is the same as that of the fourth antenna 320 as shown in FIGS. 15 and 16.

The radiating portion 522 is located on the first surface 102 of the substrate 10. The radiating portion 522 includes a first radiating part 5221, a second radiating part 5223 and a third radiating part 5225.

The first coupling and feeding portion 524 is located on the first surface 102 of the substrate 10 and includes a feeding part 241, a matching part 243 and a coupling part 5245. Each of the dimensional and the position and the shape of the feeding part 241 and the matching part 243 of the sixth antenna 520 is the same as that of the first antenna 20 as shown in FIG. 1. The coupling part 5245 includes a first coupling unit 5245*a* and a second coupling unit 5245*b*.

In one embodiment, the first coupling unit 5245*a* is located on the outside of the radiating portion 522 and parallel to the radiating portion 522. The space between the first coupling unit 5245*a* and the radiating portion 522 is about 0.5 mm. Therefore, current under a specific frequency can be coupled to the radiating portion 522 by the coupling part 5245 of the first coupling and feeding portion 524, and the radiating portion 522 can generate radiation and resonance. Thus, current through the second coupling and feeding portion 526 from the first coupling and feeding portion 524 through direct coupling and current through the coupling and feeding portion 524 from the coupling and feeding portion 526 through direct coupling are greatly reduced to improve isolation between the first coupling and feeding portion 524 and the second coupling and feeding portion 526.

In one embodiment, the first coupling and feeding portion 524 has a structure symmetrical structure to the second coupling and feeding portion 526, and the first and second coupling and feeding portions 524 and 526 are defined in axial symmetry and shares the same axis of symmetry with the radiating portion 522.

Figure 25:
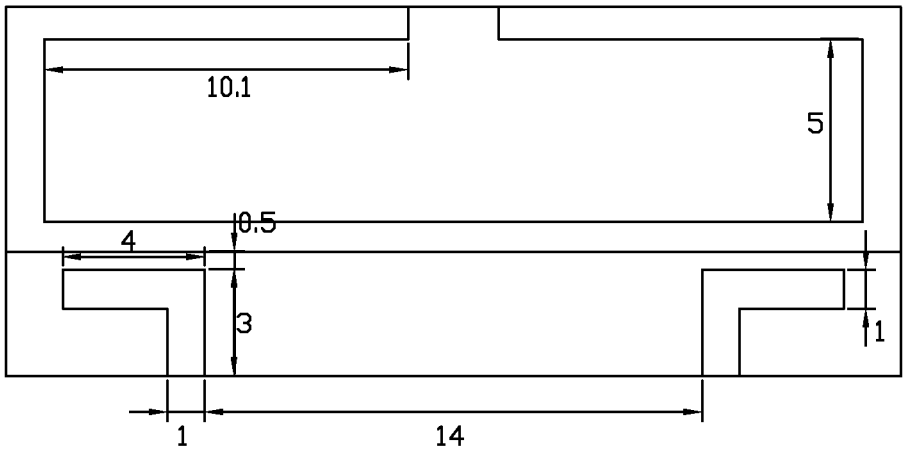
FIG. 25 shows a dimensional view of the radiating portion and the coupling and feeding portion of the sixth antenna shown in FIG. 23 in accordance with the present disclosure.

FIG. 25 shows a dimensional view of the radiating portion and the coupling and feeding portion 524 and 526 of the sixth antenna 520 shown in FIG. 23 in accordance with the present disclosure.

In one embodiment, length and width of the first radiating part 5221 of the radiating portion 522 are about 5+10.1=15.1 millimeters (mm) and 1 mm, respectively. In one embodiment, length and width of the second radiating part 5223 of the radiating portion 522 are about 15.1 mm and 1 mm, respectively. In one embodiment, length and width of the third radiating part 5225 of the radiating portion 522 are about 4+14+4=18 mm and 1 mm, respectively.

In one embodiment, length and width of the first coupling unit 5245*a* of the first coupling and feeding portion 524 are about 4 mm and 1 mm, respectively. Length and width of the second coupling unit 5245*b* of the fourth coupling and feeding portion 524 are about 3 mm and 1 mm, respectively.

Dimensions of each part of the second coupling and feeding portion 526 is same as dimensions of each part of the second coupling and feeding portion 524. The gap between the second coupling unit 5245*b* of the first coupling and feeding portion 524 and the second coupling and feeding portion 526 is about 14 mm.

Figure 26:
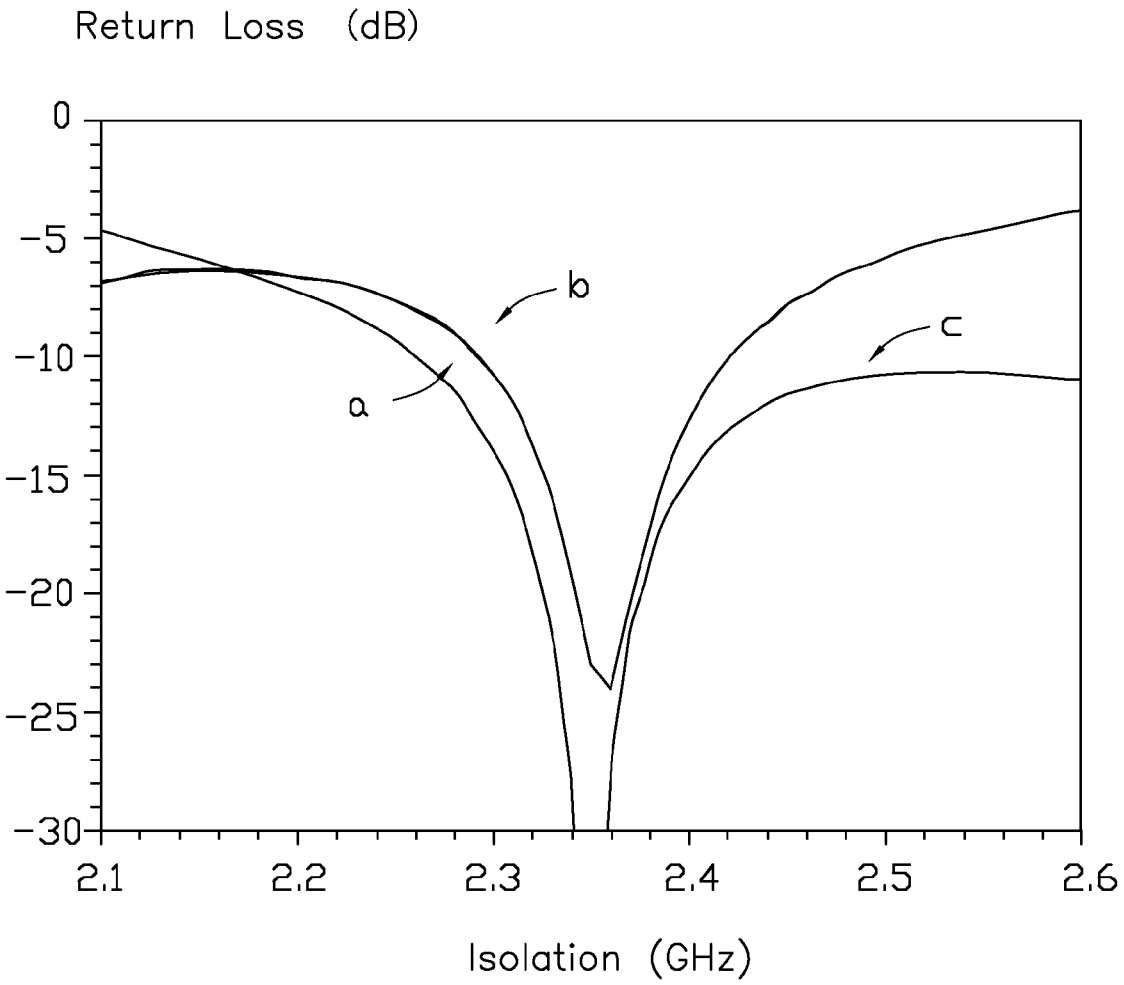
FIG. 26 shows a schematic view of one embodiment of return loss and isolation measurement for the sixth antenna shown in FIG. 23 in accordance with the present disclosure.

FIG. 26 shows a schematic view of one embodiment of return loss and isolation measurement for the sixth antenna 520 shown in FIG. 23 in accordance with the present disclosure.

As shown in FIG. 26, curve a and curve b represent the return loss for the first antenna coupling and feeding portion 524 and the second coupling and feeding portion 526 respectively, while curve c represents the isolation for the sixth antenna 520. The sixth antenna 520 is structurally symmetrical, so the curve a is fundamentally the same as the curve b. The present disclosure enables the sixth antenna 520 to cover radio frequency bands 2.3 GHz-2.4 GHz under Long Term Evolution (LTE) over and achieves effects of the MIMO antenna which return loss attenuation is less than −10 decibels (dB), which is applicable to communication standards, provides better isolation and greatly ameliorates radiating performance of the sixth antenna 520.

As mentioned, the present disclosure defines a length of each of the first radiating portion 22, the fifth radiating portion 422 and the sixth radiating portion 522 of an antenna as about $\lambda/2$. A gap is defined between each of the first radiating portion 22, the fifth radiating portion 422 and the sixth radiating portion 522, and the each of the first coupling and feeding portion 24 of the first antenna 20, the first coupling and feeding portion 124 of the second antenna 120, the first coupling and feeding portion 224 of the third antenna 220, the first coupling and feeding portion 324 of the fourth antenna 320, the first coupling and feeding portion 24 of the fifth antenna 420, the first coupling and feeding portion 524 of the sixth antenna 520, the second coupling and feeding portion 26 of the first antenna 20, the second coupling and feeding portion 126 of the second antenna 120, the second coupling and feeding portion 226 of the third antenna 220, the second coupling and feeding portion 326 of the fourth antenna 320, the second coupling and feeding portion 26 of the fifth antenna 420, the second coupling and feeding portion 526 of the sixth antenna 520 respectively. Thus, the antenna achieves effects of a MIMO antenna and antenna isolation is meliorated to enhance radiating performance of the antenna.

Although the features and elements of the present disclosure are described as embodiments in particular combinations, each feature or element can be used alone or in other various combinations within the principles of the present disclosure to the full extent indicated by the broad general meaning of the terms in which the appended claims are expressed.

What is claimed is:

1. An antenna located on a substrate, comprising:

a radiating portion about $\lambda/2$ in length, wherein the $\lambda$ indicates wavelength of electromagnetic signals radiated by the antenna;

a first coupling and feeding portion comprising a feeding part and a coupling part; and a second coupling and feeding portion comprising a feeding part and a coupling part;

wherein the feeding parts of the first coupling and feeding portion and the second coupling and feeding portion feed the electromagnetic signals to the radiating portion via respective coupling parts of the first coupling and feeding portion and the second coupling feeding portion;

wherein a gap is defined between the coupling parts of the first and second coupling and feeding portions and the radiating portion;

wherein the radiating portion comprises a first radiating part, a second radiating part and a third radiating part, wherein the first radiating part, the third radiating part, and the second radiating part are connected in series and collectively form a meandering pattern, wherein the first radiating part and the second radiating part are both in the shape of an "L" and are axial symmetric, wherein the third radiating part is in a strip shape, where the first radiating part, the third radiating part, and the second radiating part collectively form a rectangle with a gap defined at center of one side of the rectangle;

wherein the substrate comprises a first surface and a second surface opposite to the first surface, wherein the first and second coupling and feeding portions are located on the first surface of the substrate, wherein the radiating portion are located on the second surface of the substrate;

wherein a projection of the radiating portion on the first surface overlaps with the each coupling part of the first and second coupling and feeding portions, wherein the gap is defined between the coupling parts of the first and second coupling and feeding portions and the radiating portion due to a partition/separation of the substrate.

2. The antenna as claimed in claim 1, wherein each coupling part of the first and second coupling and feeding portions comprises an elongated first coupling unit, an elongated second coupling unit, and an elongated third coupling unit, wherein one end of the first coupling unit is perpendicularly connected to the second coupling unit, one end of the third coupling unit is perpendicularly connected to the second coupling unit, length of the first coupling unit is less than length of the third coupling unit, a projection of the third radiating part on the first surface overlaps with the first coupling unit and the third coupling unit, wherein the gap is defined between the third radiating part and the first and third coupling units due to a partition/separation of the substrate.

3. The antenna as claimed in claim 1, wherein each coupling part of the first and second coupling and feeding portions comprises an elongated first coupling unit and an elongated second coupling unit, wherein the first and second coupling units that perpendicularly connect together to form a "T" shape, the projection of the third radiating part on the first surface overlaps with the first coupling unit, wherein the gap is defined between the third radiating part and the first coupling unit due to a partition/separation of the substrate.

4. The antenna as claimed in claim 1, wherein each coupling part of the first and second coupling and feeding portions comprises an elongated first coupling unit and an elongated second coupling unit, wherein the first and second coupling units that perpendicularly connect together to form an "L" shape, the projection of the third radiating part on the first surface overlaps with the first coupling unit, wherein the gap is defined between the third radiating part and the first coupling unit due to a partition/separation of the substrate.

5. The antenna as claimed in claim 1, wherein the radiating portion comprises a first radiating part, a second radiating part and a third radiating part, wherein each of the first radiating part and the second radiating part has an "S" shape, the third radiating part has a "U" shape, one end of the third radiating part is perpendicularly connected to the first radiating part while the other end is perpendicularly connected to the second radiating part.

6. The antenna as claimed in claim 5, wherein each coupling part of the first and second coupling and feeding portions comprises an elongated first coupling unit, an elongated second coupling unit, and an elongated third coupling unit, wherein the second coupling unit is parallel to the symmetrical axis of the radiating portion and locates between the first coupling unit and the third coupling unit, wherein the first coupling unit and the third coupling unit are parallel to each other, wherein the first and second coupling units perpendicularly connect together to form an "L" shape, the second and third coupling units perpendicularly connect together to form a "T" shape, a projection of the third radiating part on the first surface overlaps with the first coupling unit, and the gap is defined between the third radiating part and the first coupling unit due to a partition/separation of the substrate.

7. The antenna as claimed in claim 1, wherein the first coupling and feeding portion and the second coupling and feeding portion and the radiating portion are located on the same surface.

8. The antenna as claimed in claim 7, wherein the radiating portion comprises a first radiating part, a second radiating part and a third radiating part, wherein the first radiating part, the third radiating part, and the second radiating part are connected in series and collectively form a meandering pattern, wherein the first radiating part and the second radiating part are both in the shape of an "L" and are axial symmetrical, wherein the third radiating part is in strip shape, where the first radiating part, the third radiating part, and the second radiating part collectively form a rectangle with a gap defined at center of one side of the rectangle.

9. The antenna as claimed in claim 8, wherein each coupling part of the first and second coupling and feeding portions comprises an elongated first coupling unit and an elongated second coupling unit, wherein the first and second coupling units that perpendicularly connect together to form an "L" shape.

10. The antenna as claimed in claim 9, wherein each first coupling unit of the first and second coupling portions is parallel to the third radiating part, wherein the gap is defined between the first coupling units of the first and second coupling and feed portions and the third radiating part.

11. An antenna located on a substrate, comprising:

a radiating portion about $\lambda/2$ in length, wherein the $\lambda$ indicates wavelength of electromagnetic signals radiated by the antenna;

a first coupling and feeding portion comprising a feeding part and a coupling part; and a second coupling and feeding portion comprising a feeding part and a coupling part;

wherein the feeding parts of the first coupling and feeding portion and the second coupling and feeding portion feed the electromagnetic signals to the radiating portion via respective coupling parts of the first coupling and feeding portion and the second coupling feeding portion;

wherein a gap is defined between the coupling parts of the first and second coupling and feeding portions and the radiating portion;

wherein the radiating portion comprises a first radiating part, a second radiating part and a third radiating part, wherein the first radiating part, the third radiating part, and the second radiating part are connected in series and collectively form a meandering pattern, wherein the first radiating part and the second radiating part are both in the shape of an "L" and are axial symmetric, wherein the third radiating part is in a strip shape, where the first radiating part, the third radiating part, and the second radiating part collectively form a rectangle with a gap defined at center of one side of the rectangle;

wherein the substrate comprises a first surface and a second surface opposite to the first surface, wherein the first and second coupling and feeding portions are located on the first surface of the substrate, wherein the radiating portion are located on the second surface of the substrate;

wherein each coupling part of the first and second coupling and feeding portions comprises an elongated first coupling unit, an elongated second coupling unit, and an elongated third coupling unit, wherein the second coupling unit is parallel to a symmetrical axis of the radiating portion and locates between the first coupling unit and the third coupling unit, wherein the first coupling unit and the third coupling unit are parallel to each other, wherein the first and second coupling units perpendicularly connect together to form an "L" shape, the second and third coupling units perpendicularly connect together to form a "T" shape, a projection of the third radiating part on the first surface overlaps with the first coupling unit, and the gap is defined between the third radiating part and the first coupling unit due to a partition/separation of the substrate.

* * * * *